US005085020A

United States Patent [19]

Yamazaki

[11] Patent Number: 5,085,020

[45] Date of Patent: Feb. 4, 1992

[54] PORTABLE, ASSEMBLABLE-DISASSEMBLABLE STAIRCASE

[76] Inventor: Keiichiro Yamazaki, 6-12-1 Kameido, Koto-Ku, Tokyo, Japan

[21] Appl. No.: 471,516

[22] Filed: Jan. 29, 1990

[30] Foreign Application Priority Data

Jan. 27, 1989 [JP] Japan ..... 1-8030
Apr. 14, 1989 [JP] Japan ..... 1-94727
Apr. 14, 1989 [JP] Japan ..... 1-94728

[51] Int. Cl.[5] ..... E04F 11/02

[52] U.S. Cl. ..... 52/183; 182/187; 182/228

[58] Field of Search ..... 52/182–187; 182/178, 228

[56] References Cited

U.S. PATENT DOCUMENTS 3,474,882 10/1969 Ernst ..... 52/182
3,516,367 3/1985 Molinazza ..... 52/188
4,557,085 12/1985 Yamazaki ..... 52/182
4,619,084 10/1986 Snitman ..... 52/187

FOREIGN PATENT DOCUMENTS 2913890 10/1980 Fed. Rep. of Germany ..... 52/188
62-13459 8/1987 Japan .
600092 6/1978 Switzerland ..... 52/183

*Primary Examiner*—James L. Ridgill, Jr.
*Attorney, Agent, or Firm*—Birch, Stewart, Kolasch & Birch

[57] ABSTRACT

A portable, assemblable-disassemblable staircase includes a plurality of stair units to be assembled and disassembled, each of the stair units including a horizontal base plate, an upward joint vertically installed at a rear end of the horizontal base plate, the upward joint containing a longitudinal elongated hole bored therein, a downward joint vertically installed at a front end of the horizontal base plate, a nut fixedly installed in the downward joint, a bolt adapted to be spirally inserted into the nut through the longitudinal elongated hole of the upward joint so as to inserting and fixing the downward joint of one stair unit into and to the upward joint of the other stair unit of the plurality of stair units, and a tread to be fixed to the upper surface of the horizontal base plate, whereby the stair units are assembled by alternatively mating with the downward joint and upward joint so that horizontal sections of the downward and upward joints can be prevented from circularizing to be unrotatable.

2 Claims, 38 Drawing Sheets

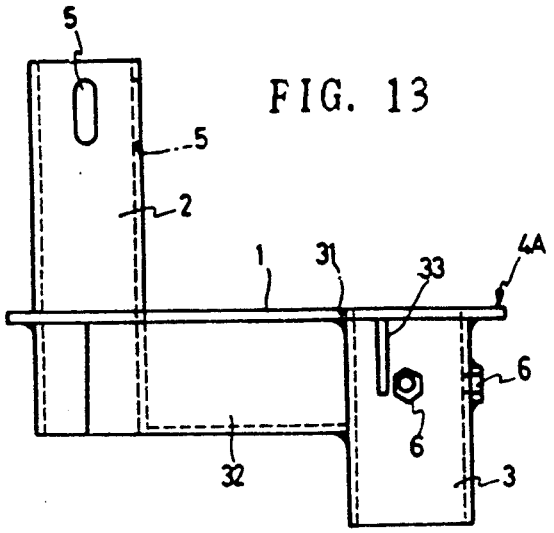
FIG. 13
FIG. 14
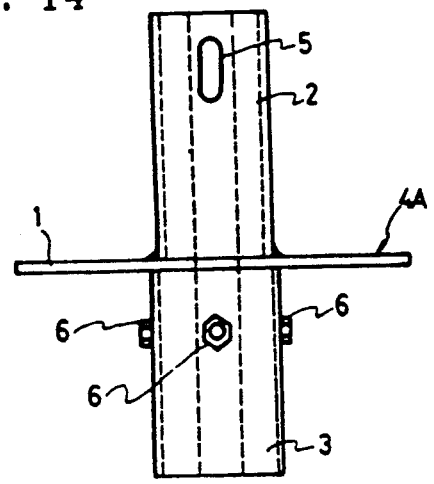
FIG. 15
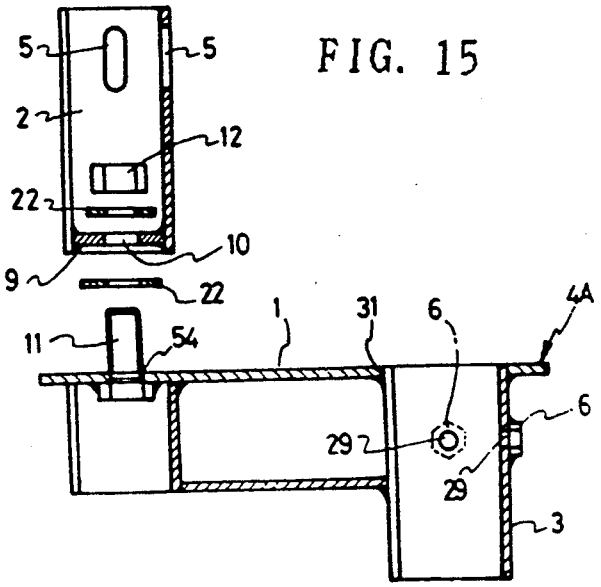

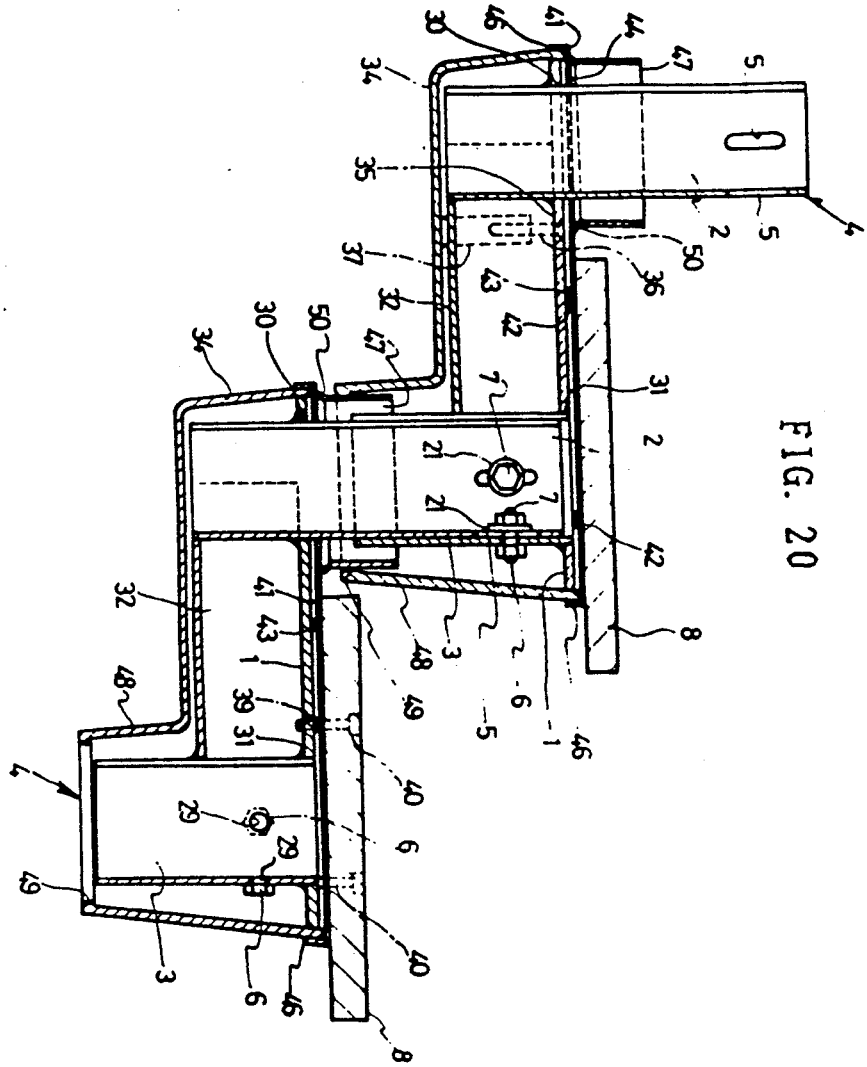
FIG. 20
FIG. 21
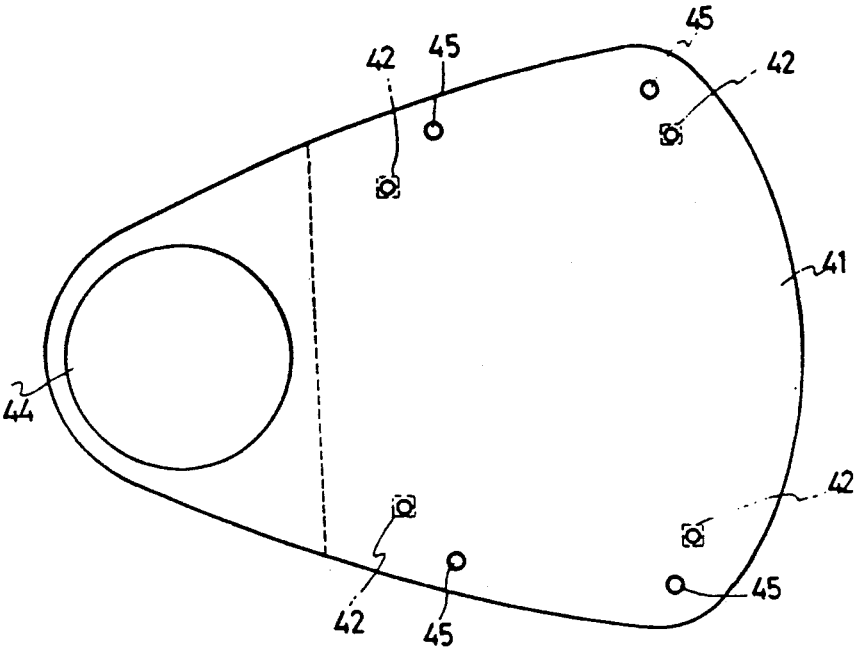

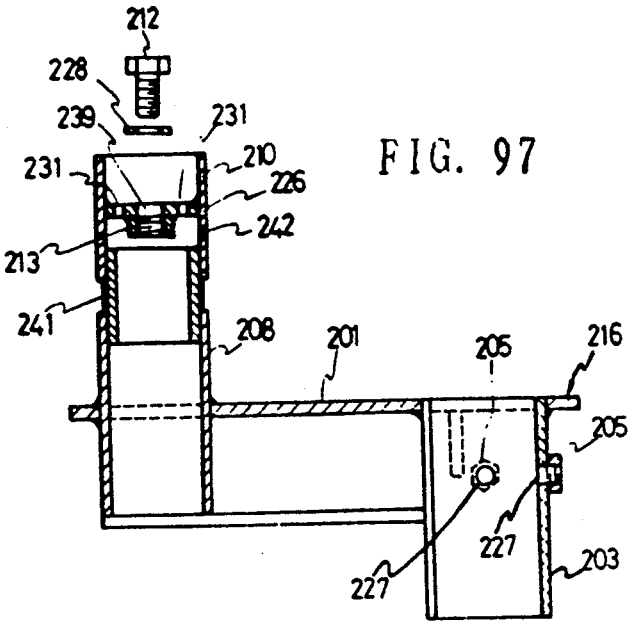
FIG. 97
FIG. 98
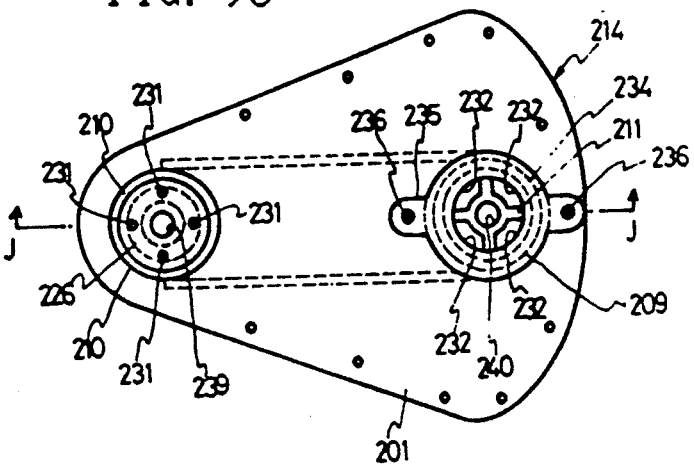
FIG. 99
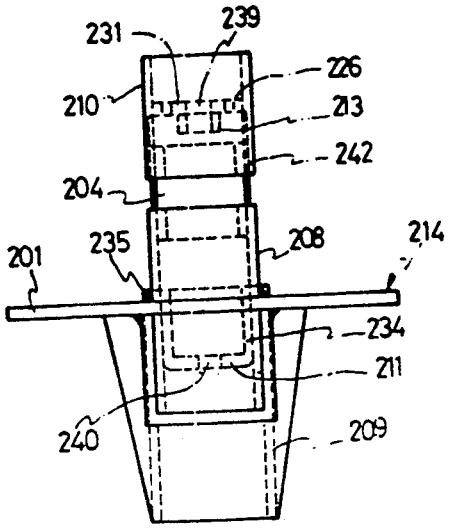

PORTABLE, ASSEMBLABLE-DISASSEMBLABLE STAIRCASE

BACKGROUND OF THE INVENTION

1. Field of the Invention

The present invention relates to a portable, assemblable-disassemblable staircase assembled by continuously connecting an upper and lower flights stair unit for use in a house or a store.

2. Description of the Prior Art

Various types of portable, assemblable-disassemblable staircases are well known in the art. One of such staircases is disclosed in Japan Patent Application Serial No. 62-13459, which comprises a cylindrical upward joint and a cylindrical downward joint which are vertically installed at a rear end and a front end of a horizontal base plate, a stair unit connected to upper and lower flights by uniting the upward joint and the downward joint, a fixing plate welded horizontally within the downward joint and provided vertically with a transparent hole in its center, a movable case connected to an end of the upward joint and inserted rotatably into the downward joint to move up and down together with the upward joint, a covering plate welded horizontally to the movable case and provided with a nut welded to its center, a bolt spirally inserted into the nut from the transparent hole so as to fix the fixing plates of the upper and lower stair units and the covering plate, and a tread fixed to the upper surface of each horizontal base plate.

The other of such staircase is disclosed, in Japan Patent Application Serial No. 62-13460 publication 62-13459, which comprises a stair unit wherein a cylindrical upward joint and a cylindrical downward joint are vertically installed at a rear end and a front end of a horizontal base plate, a fixing bolt is vertically installed in the upper central part of the upward joint, a horizontal seating plate is fixed within the downward joint, and the upward and downward joints of upper and lower stair units which are rotatably inserted/united are fixed by holding the horizontal seating plate between upper and lower nuts which are spirally united with the fixing bolt.

However, such staircases as described hereinabove require the fixing plate, the movable case, and the covering plate in addition to the cylindrical upward joint, the cylindrical downward joint, and the connection bolt as parts necessary to connect the upper stair unit and the lower stair unit.

Therefore, they require a large number of basic elements and weighs. Also, it takes a long time and they require more efforts because they entail welding of the fixing plate to the downward joint, screwing of the movable case and the upward joint, screwing of the covering plate to the movable case, and welding of the nut to the covering plate.

Furthermore, they require an assistant worker for holding the stair unit at a position where it is to be installed while an angle at which the upper and lower stair units are to be placed is adjusted by turning it and fixed by the bolt because the cylindrical upward and downward joints must be inserted and secured rotatably. Fitting of the stair units is also troublesome and labor cost is thereby made to go up.

Furthermore, as the bolts and the nuts are arranged on the longitudinal central line of the upward and downward joints, the upward and downward joints can be made rotatable when one of the bolts is loosened by an unknown cause, and fixed condition of the upper and lower stair units may be distorted and the stair case may thereby tremble dangerously.

Also, the fixing bolt is placed on the longitudinal central line of the upward joint. Therefore, when the bolt is loosened by an unaccountable cause, the upward and downward joints can be made rotatable and the fixed condition of upper and lower stair units may be distorted and the staircase may thereby tremble.

SUMMARY OF THE INVENTION

Accordingly, it is an object of the present invention to provide an assemblable-disassemblable staircase which is simple in construction, inexpensive to manufacture, durable in use, and refined in appearance.

Another object of the present invention is to provide an assemblable-disassemblable staircase which can be completely kept from trembling dangerously by reason that upward and downward joints thereof are not rotatable basically.

A further object of the present invention is to provide an assemblable-disassemblable staircase which can be optionally installed in various buildings in the form of a spiral staircase or a staircase with a landing member because an arrangement angle and height between upper and lower stair units can be adjustable.

Still another object of the present invention is to provide a portable, assemblable-disassemblable staircase which can be optionally installed in various buildings in the form of a spiral staircase or a staircase with a landing member because an arrangement angle and height between upper and lower stair units can be adjustable and although it is assembled, the staircase does not shake in the whole, in landing members, or in curved members because rotation between the stair units can be completely held in check.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a portable, assemblable-disassemblable staircase which includes an upward joint and a downward joint vertically installed at a rear end and a front end of a horizontal base plate, a stair unit connected to upper and lower flights at both side portions thereof by mutually inserting/uniting the upward joint and the downward joint, a bolt fixing the upward joint and the downward joint by spirally inserted into a nut which is fixedly installed in the downward joint from a longitudinal elongated hole bored in the upward joint, and a tread fixed to the upper surface of the horizontal base plate.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 13 is a front elevational view of FIG. 12;

FIG. 14 is a right side elevational view of FIG. 12;

FIG. 15 is a sectional view of FIG. 12, taken along line D—D;

FIG. 20 is a sectional view of the assembled staircase series having a tread attached thereto of FIG. 20;

FIG. 21 is a top plan view of a level adjusting plate assembled with the assembled staircase of FIG. 20;

FIG. 97 is a sectional view of FIG. 94, taken along line I—I;

FIG. 98 is a front elevational view of the stair unit for the curved part of the staircase according to another third formation of the present invention;

FIG. 99 is a rear elevational view of the stair unit of FIG. 98;

DESCRIPTION OF THE PREFERRED EMBODIMENTS

Figure 1:
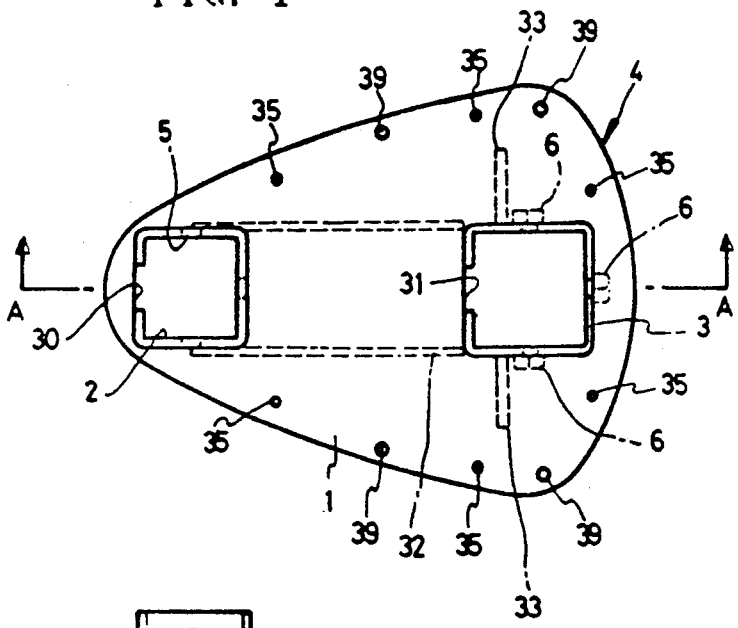
FIG. 1 is a top plan view of the stair unit of the portable, assemblable-disassemblable staircase according to a first formation of the present invention.
Figure 2:
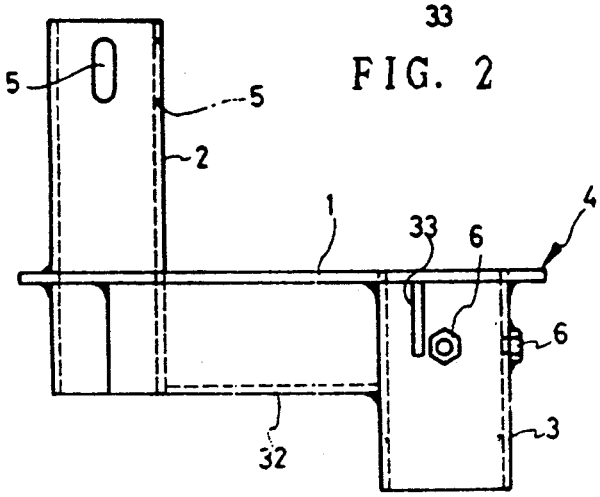
FIG. 2 is a front elevational view of the stair of portable, assemblable-disassemblable staircase of FIG. 1.
Figure 3:
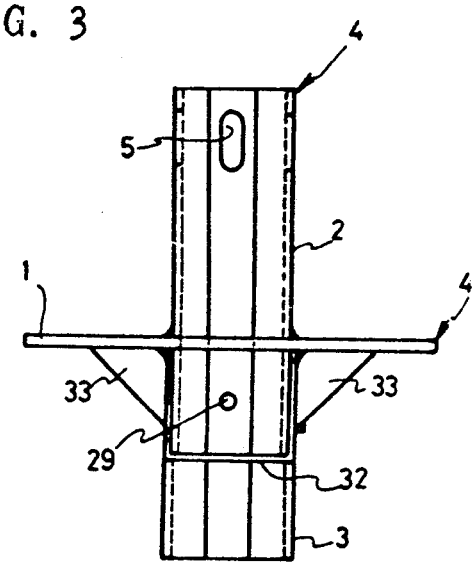
FIG. 3 is a left side elevational view of the stair unit of FIG. 1.
Figure 4:
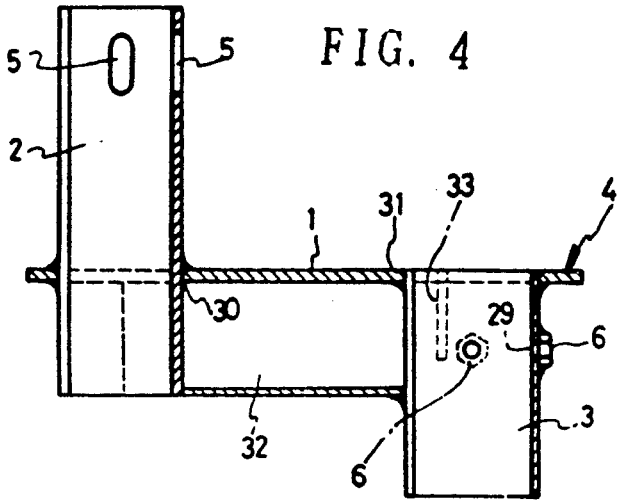
FIG. 4 is a sectional view of FIG. 1, taken along line A—A.

Referring now in detail to the drawings for the purpose of illustrating preferred embodiments of the present invention, the portable, assemblable-disassemblable staircase according to the first formation of the present invention as shown in FIGS. 1-35, which comprises an upward joint 2 and a downward joint 3 vertically installed at the rear end and the front end of a horizontal base plate 1, a stair unit 4 connected to a plurality of upper and lower flights by inserting and uniting the upward joint 2 and the downward joint 3 by spirally inserting into a nut 6 which is fixedly installed in either of the joints 2 and 3 from a longitudinal elongated hole 5 wherein the hole 5 is bored in the upward joint 2 or in the downward joint 3, and a tread 8 fixed to the upper surface of the horizontal base plate 1, thereby preventing from circularizing the transverse sections of upward joint 2 and the downward joint 3 so that the joints 2 and 3 do not mutually move and rotate.

In a first type of stair units 4A or in a second type of stair units 4B for the staircase according to the present invention, the portable, assemblable-disassemblable staircase comprises one side of the upward joint 2 and one side of downward joint 3 formed by separating from the horizontal base plate 1, a fixing plate 9 fixed to separate upward joint 2 or downward joint 3, a hole 10 disposed in the fixing plate 9 disposed on a longitudinal central line of the separate upward joint 2 or downward joint 3, and a bolt 11 vertically fixed to the horizontal base plate 1, the separate upward joint 2 or downward joint 3 being fixed to the horizontal base plate 1 by spirally tightening with a nut 12 and the bolt 11 inserted through the hole 10.

In a third type of stair units 4C or in a fourth type of stair units 4D for the staircase according to the present invention, the portable, assemblable-disassemblable staircase comprises one side of the upward joint 2 and one side of the downward joint 3 formed by separating from the horizontal base plate 1, a fixing plate 13 fixed to the separate upward joint 2 or downward joint 3, and a bolt 15 inserted through a hole 14 of the fixing plate 13 which is installed on a longitudinal central line of the separate upward joint 2 or downward joint 3, the separate upward joint 2 or downward joint 3 being fixed to the horizontal base plate 1 by spirally inserting the bolt 14 into a nut 16 which is fixedly provided in the horizontal base plate 1.

In a fifth type of stair units 4E or in a sixth type of stair units **4*f* for the staircase according to the present invention, the portable, assemblable-disassemblable staircase comprises one side of upward joint 2 and one side of downward joint 3 are formed by separating from the horizontal base plate 1, and an installing plate 17 provided in the separate upward joint 2 or downward joint 3, and the separate upward joint 2 or downward joint 3 being fixed to the horizontal base plate 1 by spirally inserting a tapping screw 19 into a receiving hole 20 which is provided in the horizontal base plate 1 from a hole 18 disposed in the installing plate 17**.

The second formation according to the present invention is illustrated as follows:

The portable, assemblable-disassemblable staircase comprises a stair unit 107 includes an upward joint 102 and a downward joint 103 projectingly installed at the rear end and front end of a horizontal base plate 101, a longitudinal elongated hole 104 disposed in a upward joint 102, a nut 105 provided in the upward joint 103, the upward and downward joints 102 and 103 of upper and lower flights which are inserted and united unrotatably being fixed by a bolt 106 spirally inserted into a nut 105 from the longitudinal elongated hole 104, a stair unit 114 in which an upward joint 108 and a downward joint 109 are vertically installed at the rear end and front end of the horizontal base plate 101, a fixing bolt 110 vertically installed in the upper central part of the upward joint 108, and a horizontal seating plate 111 fixed within the downward joint 109, the upward joint and downward joints 108 and 109 of upper and lower flights which are inserted and united rotatably being fixed by holding the horizontal seating plate 111 between an upper nut 112 and a lower nut 113 which are spirally united with the fixing bolt 110.

A stair unit 115 includes the upward joint 102 and the downward joint 109 are vertically installed at the rear end and front end of the horizontal base plate 101, the longitudinal elongated hole 104 disposed in the upward joint 102, and the horizontal seating plate 111 fixedly installed within the downward joint 109, the upward joint 102 being fixed by unrotatably setting in the downward joint 103 of the stair unit 107 and by the bolt 106 spirally inserted into the nut 105 from the longitudinal elongated hole 104 and the downward joint 109 being fixed by rotatably setting in the upward joint 108 of the stair unit 114 and holding the horizontal seating plate 111 between the upper and lower nuts 112 and 113 which are spirally united with the fixing bolt 100.

A stair unit 116 includes an upward joint 108 and a downward joint 103 are vertically installed at the rear end and front end of the horizontal base plate 101, a fixing bolt 110 vertically installed in the upper central part of the upward joint 108, and a nut 105 provided in the downward joint 103, the upward joint 108 being fixed by rotatably setting in the downward joint 109 and holding the horizontal seating plate 111 between the upper and lower nuts 112 and 113 which are spirally united with the fixing bolt 110 and the downward joint 103 being fixed by unrotatably setting in the upward joint 102 of the stair unit 107 and by the bolt 106 spirally inserted into the nut 105 from the longitudinal elongated hole 104.

A stair unit 117 for the top part which includes the downward joint 103 is vertically installed at the front end of the horizontal base plate 101, and the nut 103 fixedly installed in the downward joint 103, the downward joint 103 which is set unrotatably in the upward joint 102 of the stair unit 107 being fixed by the bolt 106 spirally into the nut 105 from the longitudinal elongated hole 104 and the horizontal base plate 101 being fixed to the floor of the upper story.

A stair unit for the base part 118 which includes the upward joint 102 is vertically installed in the horizontal base plate 101, and the longitudinal elongated hole 104 disposed in the upward joint 102, the upward joint 102 which is unrotatably set in the downward joint 103 of the stair unit 107 being fixed by the bolt 106 which is spirally inserted into the nut 105 from the hole 104 and the horizontal base plate 101 being fixed to the floor of the lower story.

A tread 119 which is fixed to the upper side of the horizontal base plate 101 in each stair unit.

The third formation according to the present invention is illustrated as follows:

The portable, assemblable-disassemblable staircase comprises a stair unit 207 incudes an upward joint 202 and a downward joint 203 vertically installed at the rear end and front end of a horizontal base plate 201, a longitudinal elongated hole 204 disposed in the upward joint 202, and a nut 205 fixedly installed in the downward joint 203, the upward and downward joints 202 and 203 of upper and lower flights being fixed by a bolt 206 spirally inserted into the nut 205 from the longitudinal elongated hole 204.

A stair unit 214 includes an upward joint 208 and a downward joint 209 vertically installed at the rear end and front end of the horizontal base plate 201, a movable case 210 vertically spirally connected to the upper end of the upward joint 208, a nut 213 is fixedly installed int he central part of the horizontal plate part 226 of the movable case 210, and a horizontal seating plate 211 fixedly installed within the downward joint 209, the upward and downward joints 208 and 209 of upper and lower flights which are rotatably set in being fixed by pressing the horizontal plate part 226 to the horizontal seating plate 211 with a bolt spirally united with a nut 213.

A stair unit 215 includes the upward joint 202 and the downward joint 209 vertically installed at the rear end and front end of the horizonal base plate 201, the longitudinal elongated hole 204 disposed in the upward joint 202, and the horizontal seating plate 211 fixedly installed within the downward joint 209, the upward joint 202 being fixed by being unrotatably set in the downward joint 203 of the stair unit 207 and by a bolt 206 spirally united with the nut 205 from the longitudinal elongated hole 204, and the downward joint 209 being fixed by being rotatably set in the upward joint 208 of the stair unit 214 and by fastening a horizontal plate part 226 to the horizonal seating plate 211 with a bolt 212 spirally united with the nut 213.

A stair unit 216 includes the upward joint 298 and the downward joint 203 vertically installed at the rear end and front end of the horizontal base plate 201, the movable case 210 vertically connected to the upper end of the upward joint 208, the nut 213 fixedly provided in the central part of the horizontal plate part 226 of the movable case 210, and a nut 205 fixedly provided in the downward joint 203, the upward joint 208 being fixed by rotatably setting in the downward joint 209 of the stair unit 214 and fastening the horizontal plate part 226 to the horizontal seating plate 211 with the bolt 212 spirally united with the nut 213 and the downward joint 203 being fixed by unrotatably setting in the upward joint 202 of the stair unit 207 and by a bolt 206 spirally inserted into the nut 205 from the longitudinal elongated hole 204.

A top stair unit 217 includes the downward joint 203 vertically installed at the front end of horizontal base plate 201, and the nut 205 fixedly provided in the downward joint 203, the downward joint 203 which is unrotatably setting the upward joint 202 of the stair unit 207 being fixed by a bolt 216 spirally inserted into the nut 205 and the horizontal base plate 201 being fixed to the floor of upper story.

A base stair unit 218 includes the upward joint 202 vertically installed in the horizontal base plate 201, and a longitudinal elongated hole 204 bored in the upward joint 202, the upward joint 202 which is unrotatably setting in the downward joint 203 of the stair unit 207 being fixed by the bolt 206 spirally inserted into the nut 205 from the penetrating hole 204 and the horizontal base plate 201 being fixed to the floor of lower story.

A tread 219 which is fixed to the upper side of the horizontal base plate 201 in each stair unit.

Figure 16:
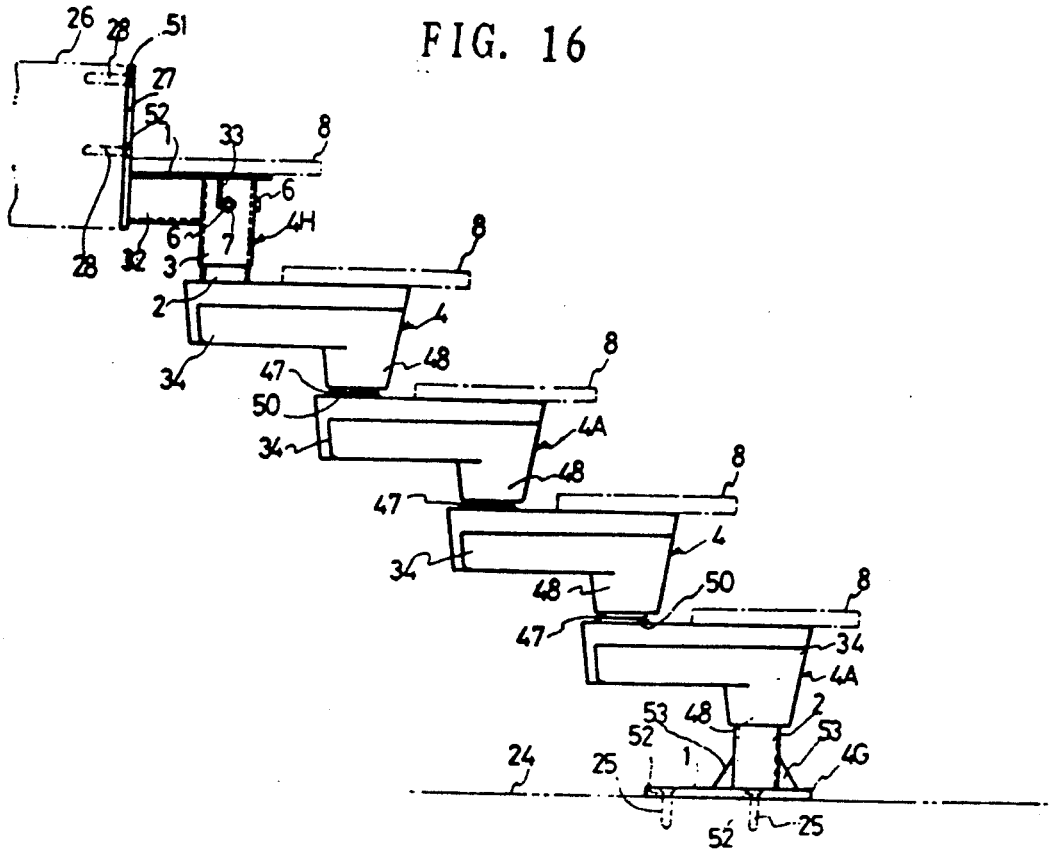
FIG. 16 is a front elevational view of the assembled staircase built up with the plurality of stair units of FIG. 12 and containing cut-away portions in order to illustrate the assembling of the stair units.

The first formation according to the present invention is assembled as follows:

The portable, assemblable-disassemblable staircase according to the present invention can be fixed up to the upper floor from the lower floor or to the lower floor from the upper floor. To fix it up from the lower floor, for example, a base stair unit 4G is fixed to the lower floor 24 as shown in FIG. 16. The base stair unit 4G is devoid of the downward joint 3 from the standard stair unit 4. The horizontal base plate 1 is fixed directly to the floor 24 by a vis 25.

Figure 18:
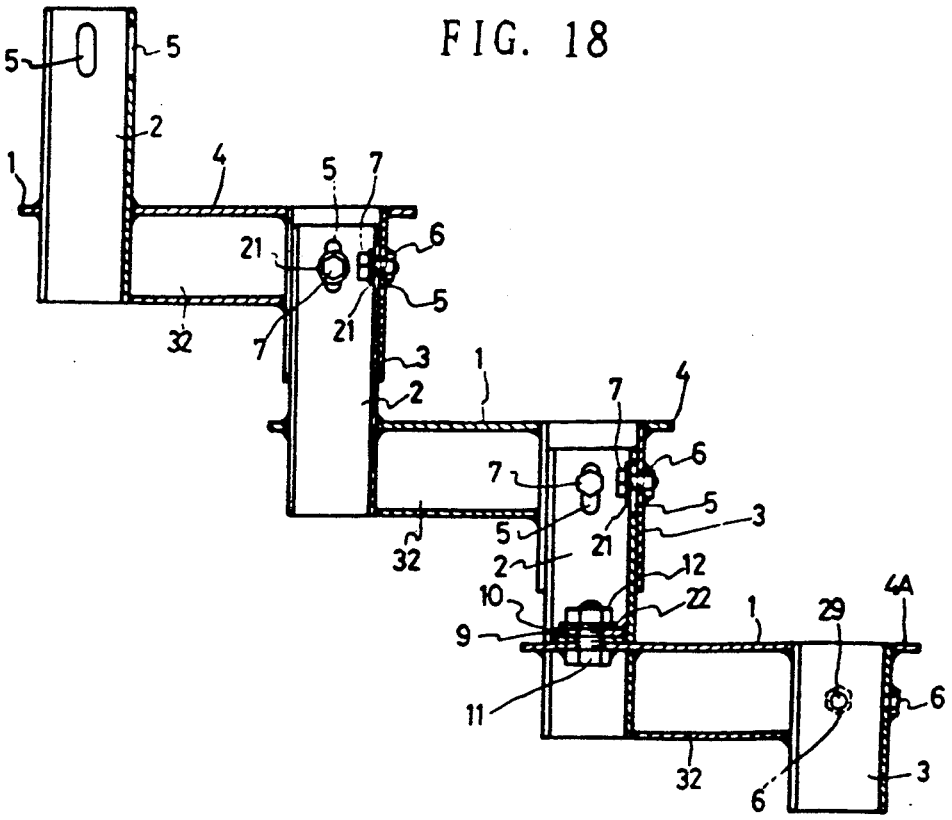
FIG. 18 is a sectional view of the middle portion of the assembled staircase series of FIG. 16.
Figure 19:
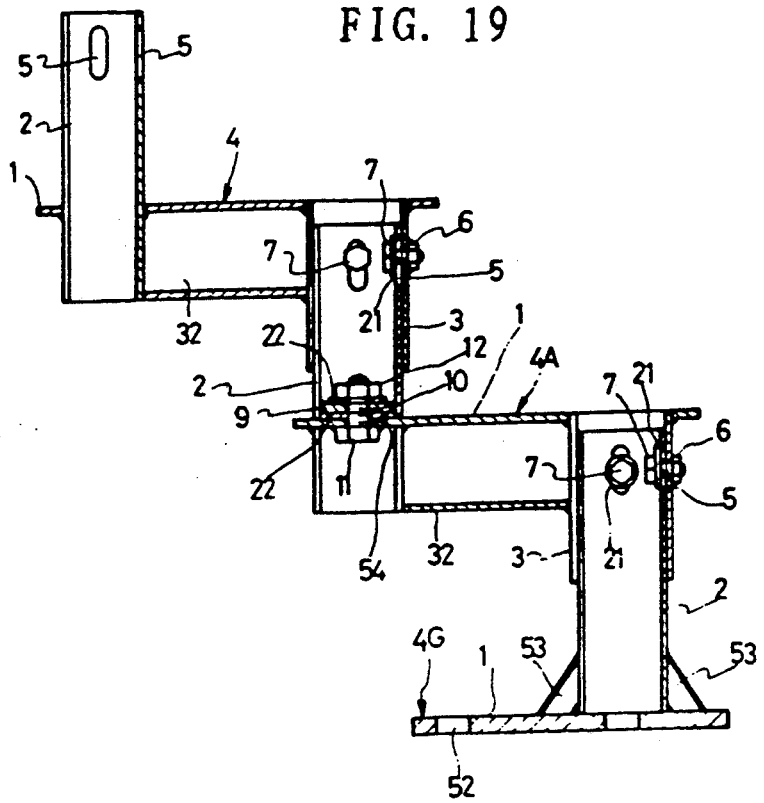
FIG. 19 is a sectional view of the lower portion of the assembled staircase of FIG. 16.

As shown in FIG. 19, the downward joint 3 of the stair unit 4 on the first flight is inserted into the upward joint 2 of the base stair unit 4G and the upward joint 2 is fixed to the downward joint 3 by a bolt 7. The bolt 7 and a bolt driving tool are inserted from the upper open parts of the upward joint 2 and the downward joint 3. Then, as shown in FIG. 18, the downward joint 3 of the stair unit 4 on the second flight is inserted into the upward joint 2 of the stair unit 4 on the first flight and the upward joint 2 is fixed to the downward joint 3 by the bolt 7.

Figure 17:
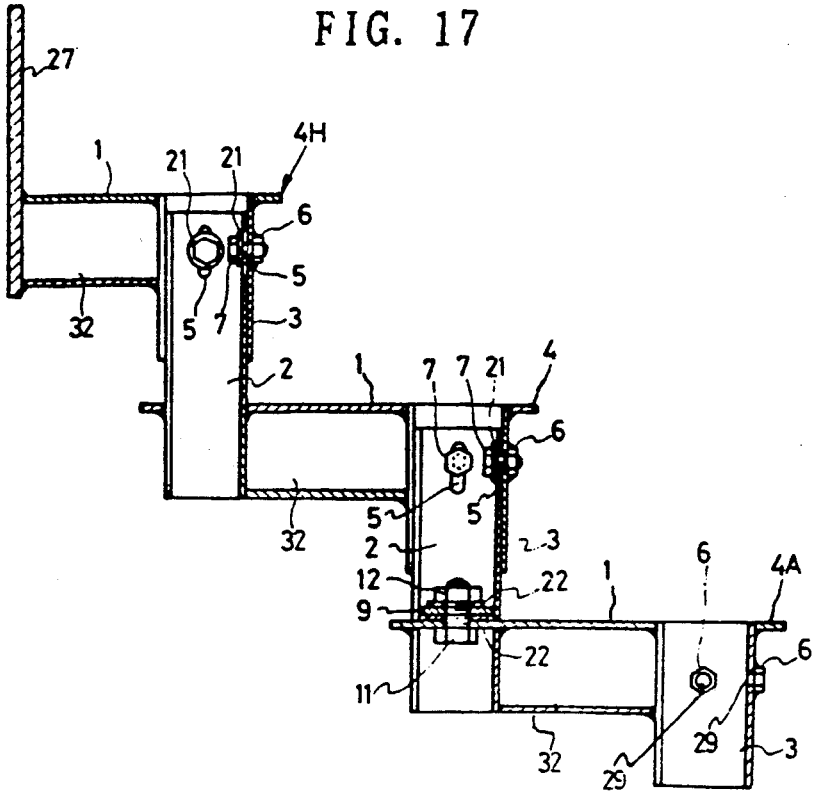
FIG. 17 is a sectional view of the upper portion of the assembled staircase of FIG. 16.

After stair units are fixed up in consecutive order up to the stair unit 4 on the second flight from the top, the downward joint 3 of a top stair unit 4H is inserted into the upward joint 2 of the stair unit 4 on the second flight from the top thereof and the upward joint 2 is fixed to the downward joint 3 by the bolt 7 (FIGS. 16 and 17). The top stair unit 4H is devoid of the upward joint 2 from the standard stair unit 4. At the rear end of the horizontal base plate 1 instead of the upward joint 2, a bracket plate 27 for the upper floor or a landing is fixedly installed. A bracket plate 27 is fixed to a floor 26 by a bolt or a screw 28.

The height between the upper stair unit 4 and the lower stair unit 4 is adjustable by means of free length between the longitudinal elongated hole 5 and the bolt 7 for every flight or several flights or for a particular flight. In this manner, the straight staircase is fixed up by arranging the upper stair unit 4 and the lower stair unit 4 from the lower story to the upper story.

As shown in FIGS. 17 to 20, one side-toothed or a both sides-toothed washer 21 is inserted between a head of the bolt 7 and the upward joint 2 or the downward joint 3 and the washer 21 is pressed by tightening the bolt 7. The upward joint 2 and the downward joint 3 are tightly connected to each other by sticking the washer 21 to its contact surface and the stair unit is not caused to sink down by loosening of the bolt 7.

In order to change or adjust the angle of arrangement between the upper and lower units in the landing part or in the curved part thereof when the staircase provided with a landing, the geometrical staircase, or the spiral staircase is fixed up, an angle adjusting stair unit 4A, 4B, 4C, 4D, 4E, or 4F is used in which the upward joint 2 or the downward joint 3 is fixed to the horizontal base plate 1 after it is turned on a longitudinal axis.

Although the standard stair unit 4 in which the upward joint 2 and the downward joint 3 are installed in the horizontal base plate 1 from the beginning assembling is generally used to fix up the straight part other than a landing part or a bending part, the straight part can be fixed up with the stair units 4A to 4F. The whole body of such straight staircase can also be fixed up with the angle adjusting stair units 4A to 4F.

Whether it is the landing part, the bending part, or the straight part, the angle adjusting stair units 4A to 4F and the standard stair unit 4 can be used by combining one or several of them.

The first angle adjusting stair unit 4A separated from the upward joint 2 is shown in FIGS. 12 to 15. The separate upward joint 2 is fixed to the horizontal base plate 1 by inserting the downward joint 3 of the stair unit 4 into the upward joint 2 of the lower stair unit 4 or into the upward joint 2 of the base stair unit 4D and fastening the upward joint 2 and the downward joint 3 with the bolt 7 and then turning the upward joint 2 to the required angle on the fixing bolt 11 for fixing the horizontal base plate 1 to the stair unit 4A and tightening a nut 12 shown in FIGS. 18 and 19.

Between the fixing plate 9 and the horizontal base plate 1 or between the nut 12 and the fixing plate 9, one side-toothed or both sides-toothed washer 22 is interposed and strongly pressed by tightening the nut 12. The upward joint 3 is tightly connected so as not to be rotatable with the horizontal base plate 1. Thus, the stair unit 4A does not move around or rattle.

Into the tightly positioned upward joint 2, the downward joint 3 of next angle adjusting stair unit 4A or the standard stair unit 4 is inserted and fixed thereto by tightening the bolt 7.

Figure 30:
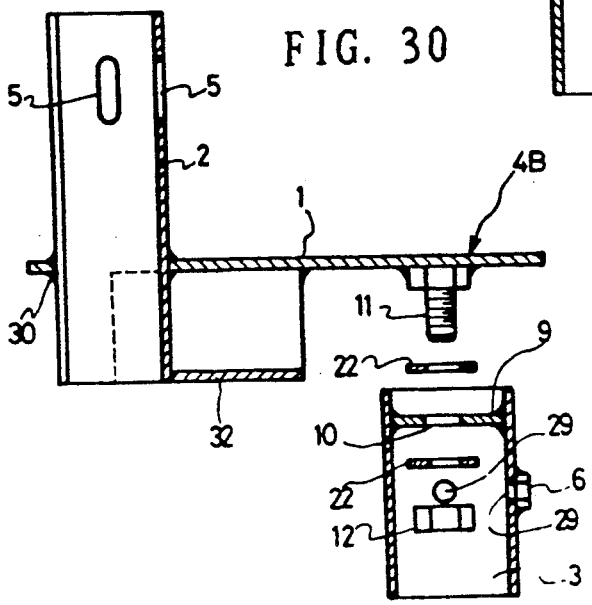
FIG. 30 is a sectional view of another embodiment of the angle adjusting stair unit having one disassembled portion according to the present invention.

The second angle adjusting stair unit 4B separated from the downward joint 3 as shown in FIG. 30 is used. The upward joint 2 of the stair unit 4B is inserted into the downward joint 3 of the upper stair unit 4 or the downward joint 3 of the top stair unit 4H. The downward joint 3 is fixed to the upward joint 2 by tightening the bolt 7. The downward joint 3 is fixed to the horizontal base plate 1 by turning to the required angle on the fixing bolt 11 for the tightly positioned horizontal base plate 1 of the stair unit 4B and tightening the nut 12.

Between the fixing plate 9 and the horizontal base plate 1 or between the nut 12 and the fixing plate 9, one side-toothed or both sides-toothed washer 22 is interposed and strongly pressed by tightening the nut 12. The upward joint 2 is thereby connected so tightly as not to be rotatable with the horizontal base plate 1. Therefore, the stair unit 4A does not rattle by loosening of the nut 12.

Into the tightly positioned downward joint 3, the upward joint 2 of next angle adjusting stair unit 4B or the standard stair unit 4 is inserted and fixed thereto by tightening the bolt 7.

Figure 31:
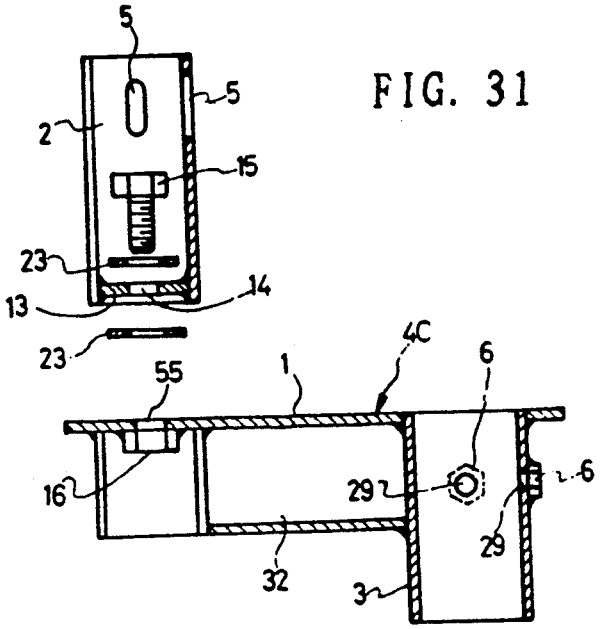
FIG. 31 is a sectional view of a further embodiment of the angle adjusting stair unit having one disassembled portion according to the present invention.

The third angle adjusting stair unit 4C separated from the upward joint 2 as shown in FIG. 31 is used. The downward joint 3 of the stair unit 4C is inserted into the upward joint 2 of the lower standard stair unit 4 or the upward joint 2 of the base stair unit 4G and the upward joint 2 is fixed to the downward joint 3 by tightening the bolt 7. The upward joint 2 is fixed to the horizontal base plate 1 by turning to the required angle on the bolt 15 inserted into a nut 16 for the horizontal base plate of the stair unit 4C and tightening a bolt 15.

Between the fixing plate 13 and the horizontal base plate 1 or between the bolt 15 and the fixing plate 13 one side-toothed or both sides-toothed washer 23 is interposed and strongly pressed by tightening the bolt 15. The upward joint 2 is thereby connected so tightly as not to be rotatable with the horizontal base plate 1. Thus, the stair unit 4A does not move round or rattle by loosening of the bolt 15.

Into this tightly positioned upward joint 2, the downward joint 3 of next angle adjustment-type stair unit 4C or standard-type stair unit 4 is inserted and fixed thereto by tightening a bolt 7.

Figure 32:
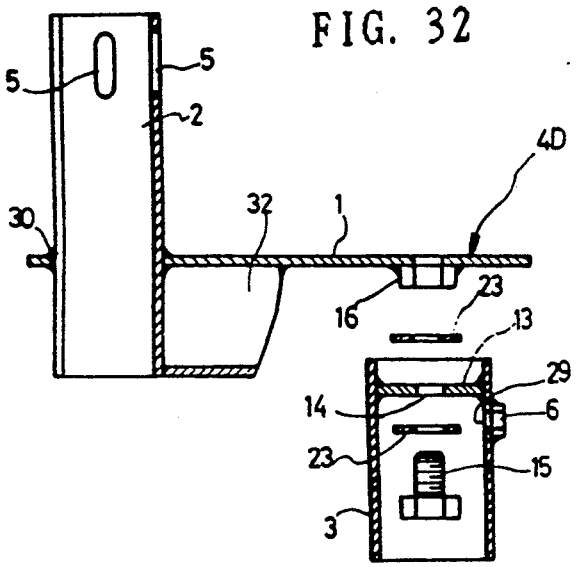
FIG. 32 is a sectional view of a further embodiment of the angle adjusting stair unit having one disassembled portion of FIG. 31.

The fourth angle adjusting stair unit 4D separated from the downward joint 3 as illustrated in FIG. 32 is used. The upward joint 2 of the stair unit 4D is inserted into the downward joint 3 of the upper standard stair unit 4 or the downward joint 3 of the base stair unit 4H and the downward joint 3 is fixed to the upward joint 2 by tightening the bolt 7. The downward joint 3 is fixed to the horizontal base plate 1 by turning to the required angle on the bolts 15 inserted into the nut 16 for the horizontal base plate 1 of the stair unit 4D and by tightening the bolt 15.

Between the fixing plate 13 and the horizontal base plate 1 or between the bolt 15 and the fixing plate 13, one side-toothed or both sides-toothed washer 23 is interposed and strongly pressed by tightening the bolt 15. The upward joint 2 is thereby connected so tightly as not to be rotatable with the horizontal base plate 1. Thus, the stair unit 4A does not move around or rattle by loosening of the bolt 15. Into the tightly positioned downward joint 3, the upward joint 2 of next angle adjusting stair unit 4D or the standard stair unit 4 is inserted and fixed thereto by tightening the bolt 7.

Figure 33:
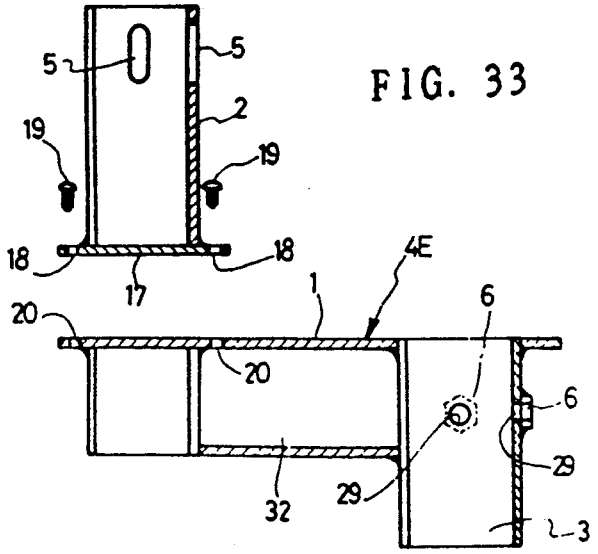
FIG. 33 is a sectional view of yet another embodiment of the angle adjusting stair unit having one disassembled portion according to the present invention.
Figure 34:
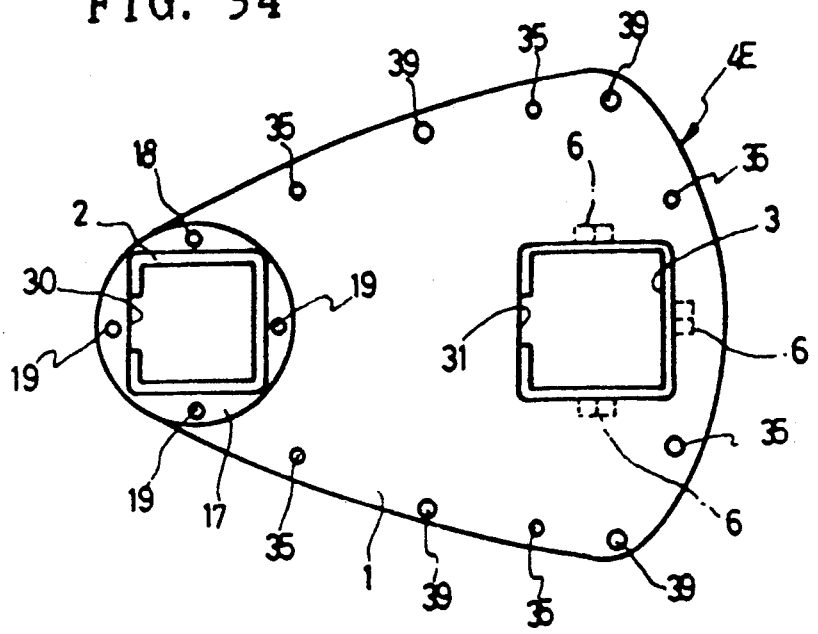
FIG. 34 is a top plan view of FIG. 33.

The fifth angle adjusting stair unit 4E separated from the upward joint 2 as shown in FIG. 33 is used. The downward joint 3 of the stair unit 4E is inserted into the upward joint 2 of the lower standard stair unit 4 or into the upward joint 2 of the base stair unit 4G and the upward joint 2 is fixed to the downward joint 3 by tightening the bolt 7. The upward joint 2 is turned to the required angle for the horizontal base plate 1 of the stair unit 4E. As shown in FIG. 34, a receiving hole 20 which corresponds with a penetrating hole 18 of an installing plate 17 is bored with a drill under the condition that the upward joint 2 is kept at its position and the tapping screw 19 is spirally inserted into the receiving hole 20 from the penetrating hole 18, whereby the upward joint 2 is fixed to the horizontal base plate 1.

Into the tightly positioned upward joint 2, the downward joint 3 of next angle adjusting stair unit 4E or the standard stair unit 4 is inserted and fixed thereto by tightening the bolt 7.

Figure 35:
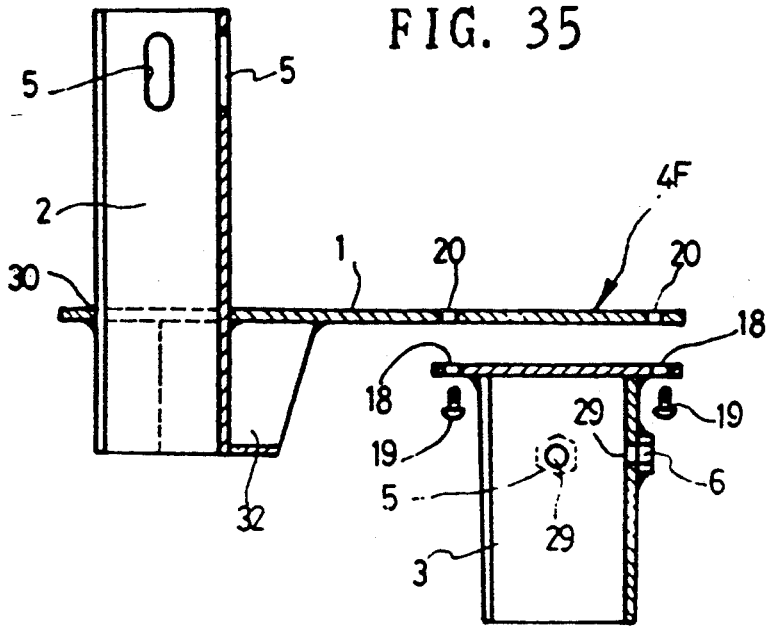
FIG. 35 is a sectional view of yet another embodiment of angle adjusting stair unit having the other disassembled portion of FIG. 33.

The sixth angle adjusting stair unit 4F separated from the downward joint 3 as illustrated in FIG. 35 is used. The upward joint 2 of the stair unit 4F is inserted into the downward joint 3 of the upper standard stair unit 4 or the downward joint 3 of the top stair unit 4H and the downward joint 3 is fixed to the upward joint 2 by tightening the bolt 7. The downward joint 3 is turned to the required angle for the horizontal base plate 1 of the stair unit 4F. After the receiving hole 20 which corresponds with the penetrating hole 18 of the installing plate 17 is bored in the horizontal base plate 1 with a drill under the condition that the downward joint 3 is kept at its position. The tapping screw 19 is spirally inserted into the receiving hole 20 from the penetrating hole 10 and the downward joint 3 is thereby fixed to the horizontal base plate 1.

Into the tightly positioned downward joint 3, the upward joint 2 of next angle adjusting stair unit 4F or the standard stair unit 4 is inserted and fixed thereto by tightening the bolt 7.

Figure 37:
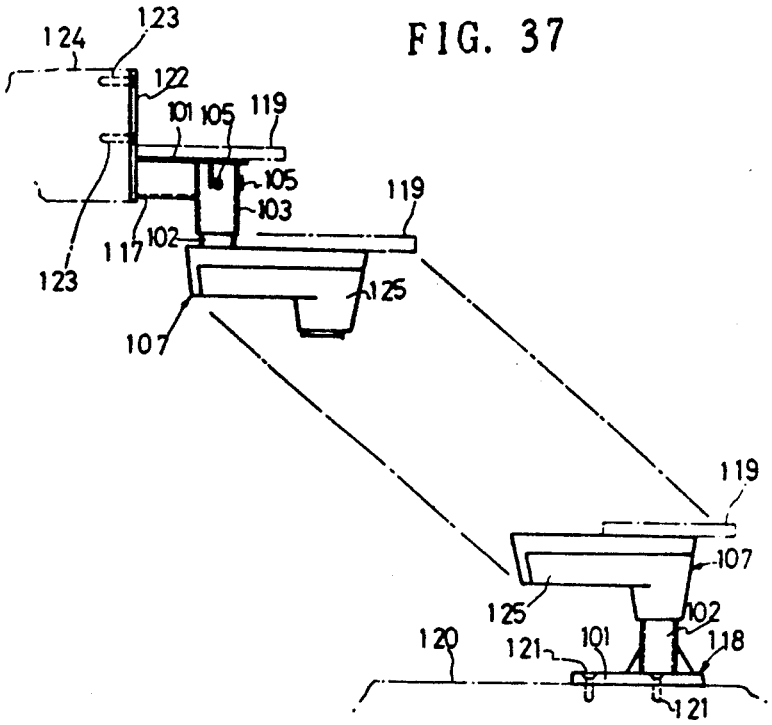
FIG. 37 is a diagrammatic left side elevational view of the assembled staircase of FIG. 36.

The second formation according to the present invention is assembled as follows:

The portable, assemblable-disassemblable staircase according to the present invention can be fixed up to the upper floor from the lower floor or to the lower floor from the upper floor. To fix it up from the lower floor, for example, the horizontal base plate 101 of the base stair unit 118 is fixed to the lower floor 120 with a screw 121 as shown in FIG. 37.

Figure 36:
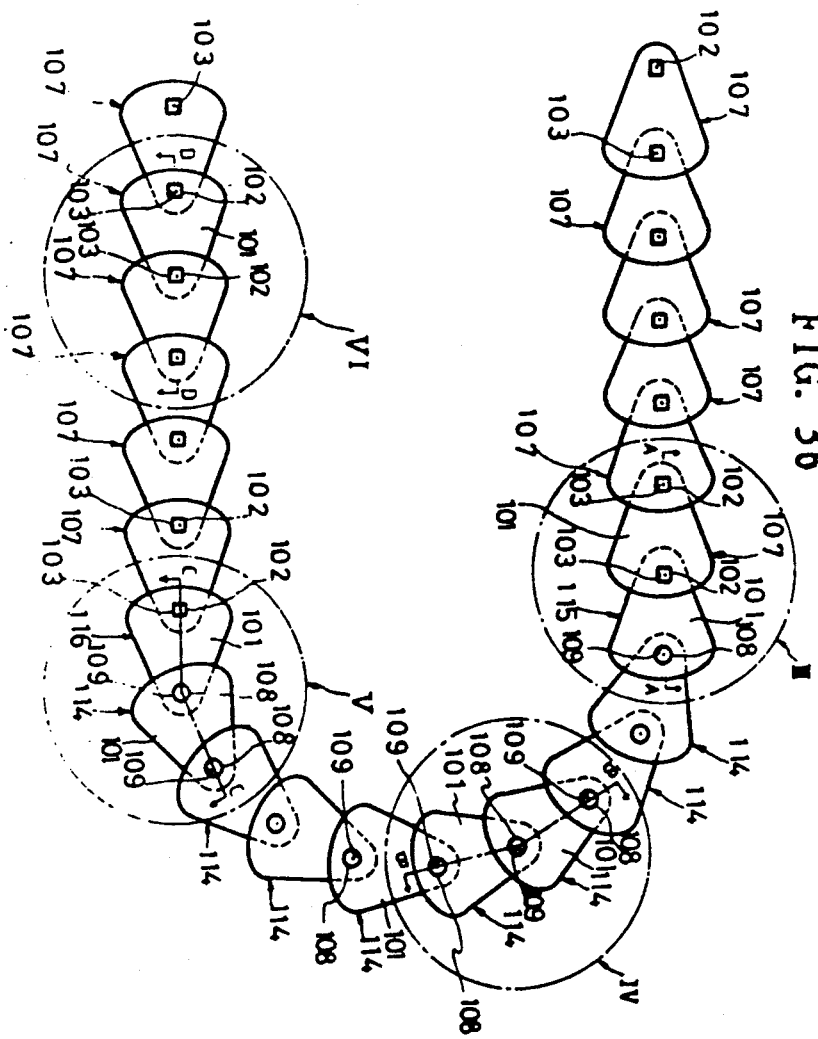
FIG. 36 is a diagrammatic top plan view of the assembled staircase according to the a second formation of the present invention.

When the straight part connected between the upper floor and the lower floor is fixed up by means of the stair unit 107, the curved part like a landing is fixed up by means of the stair unit 114 as illustrated in FIG. 36, the downward joint 103 of the first stair unit 107 for straight part thereof is inserted into the upward joint 102 of the base stair unit 188 and the upward joint 102 is fixed to the downward joint 103 by tightening a bolt 106. The bolt 106 and a driving tool are inserted from the upper opened part of the upper joint 102 and the downward joint 103 (FIG. 37).

Figure 41:
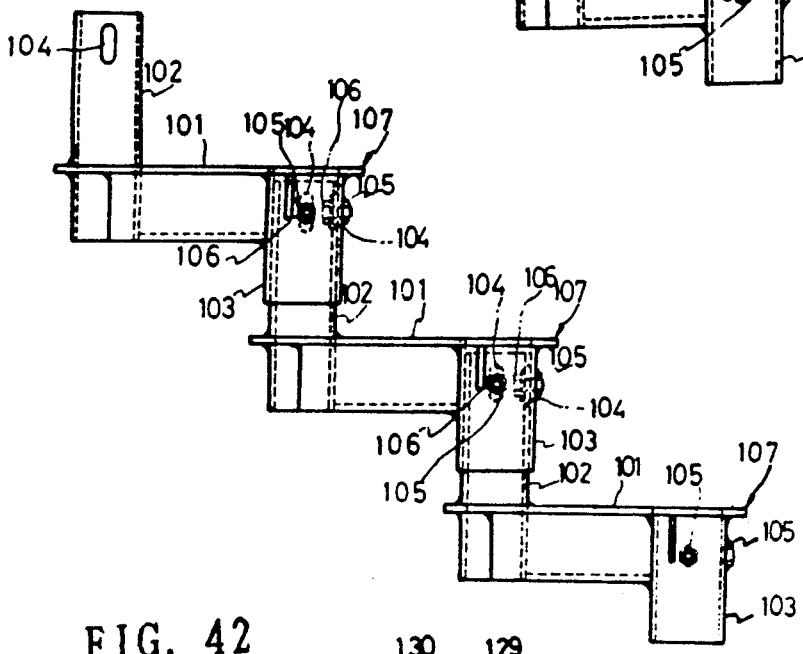
FIG. 41 is a sectional view of the circle VI shown in FIG. 36, taken along line D—D illustrating the straight part thereof.
Figure 42:
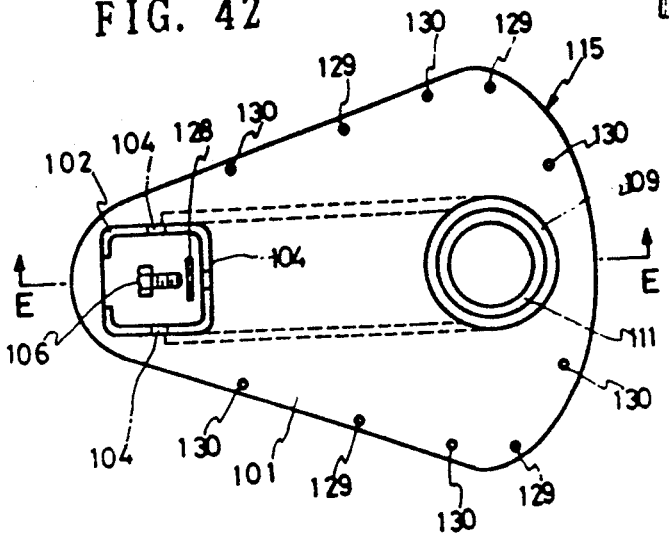
FIG. 42 is a top plan view of the stair unit for changing to the curved part from the straight part of the staircase according to the formation.
Figure 43:
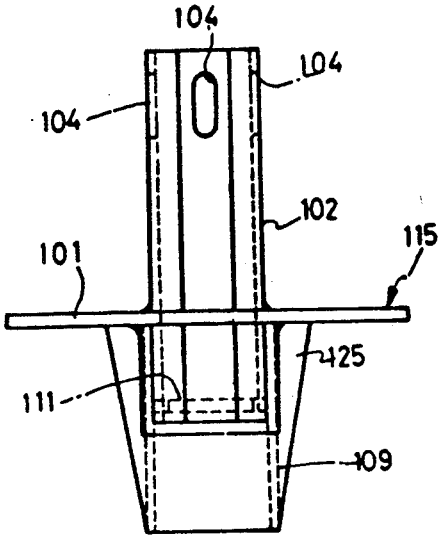
FIG. 43 is a rear elevational view of stair unit of FIG. 42.
Figure 44:
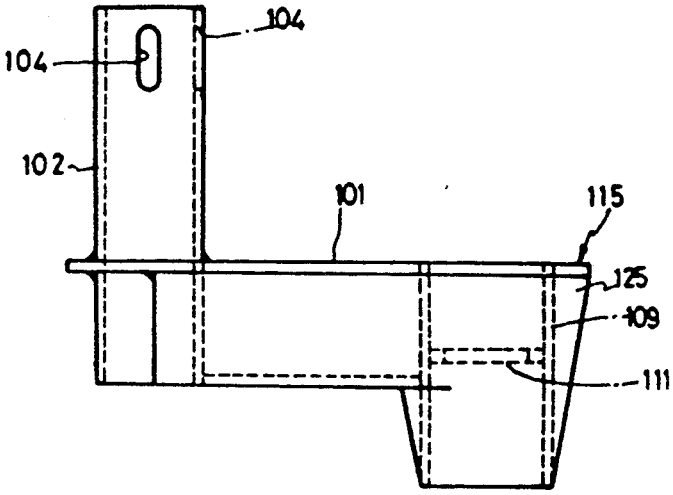
FIG. 44 is a left side elevational view of the stair unit of FIG. 42.
Figure 45:
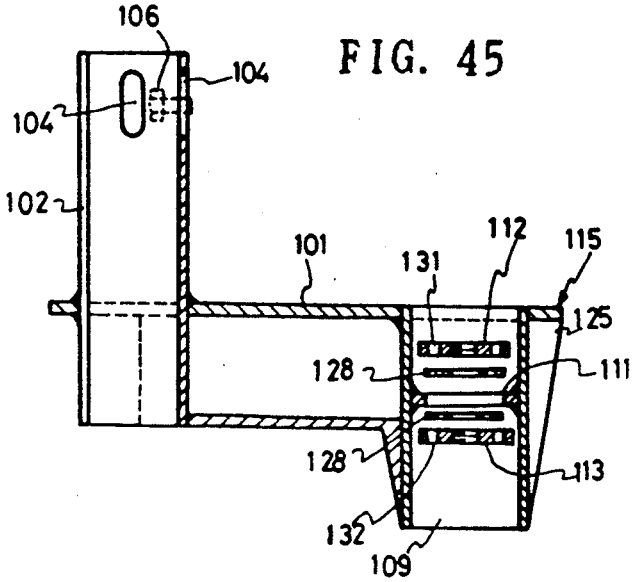
FIG. 45 is a sectional view of FIG. 42, taken along line E—E.
Figure 46:
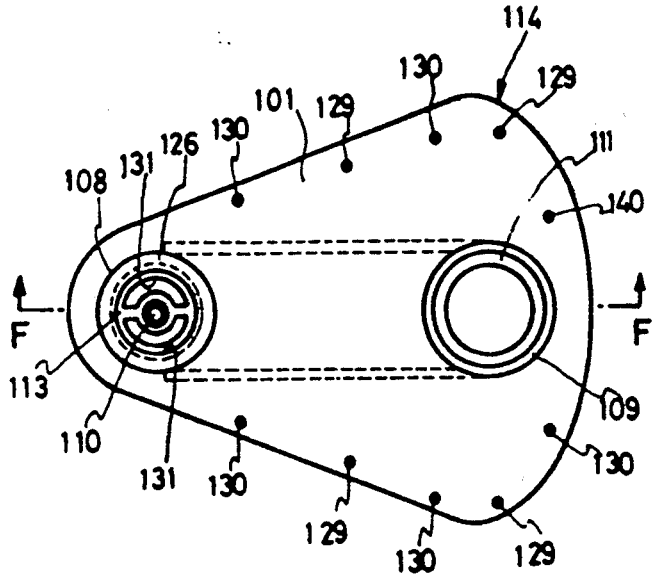
FIG. 46 is a top plan view of the stair unit for curved part of the staircase of FIG. 36.
Figure 47:
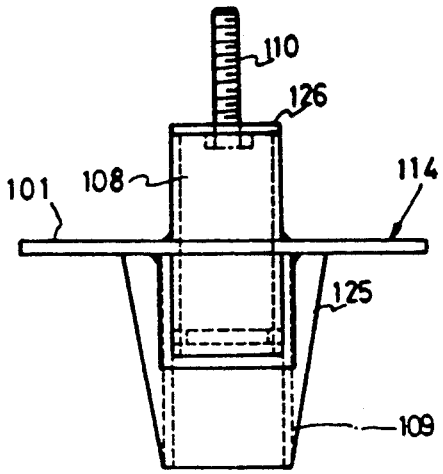
FIG. 47 is a rear elevational view of the stair unit of FIG. 46.
Figure 48:
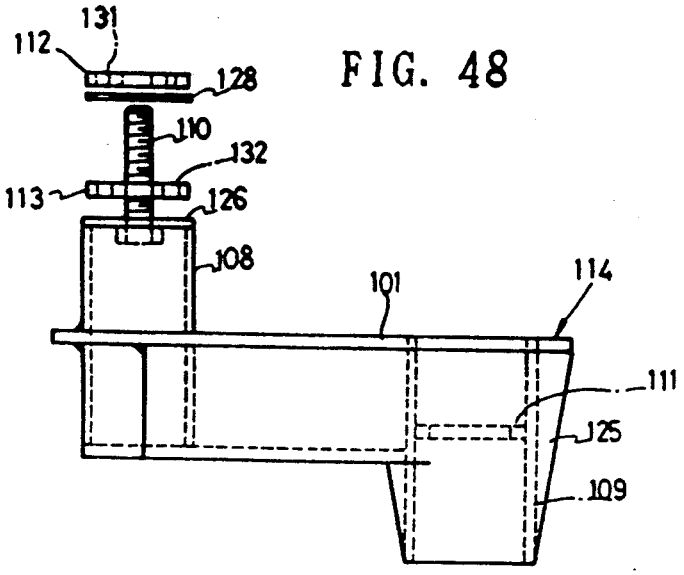
FIG. 48 is a left side elevational view of the stair unit of FIG. 46.
Figure 49:
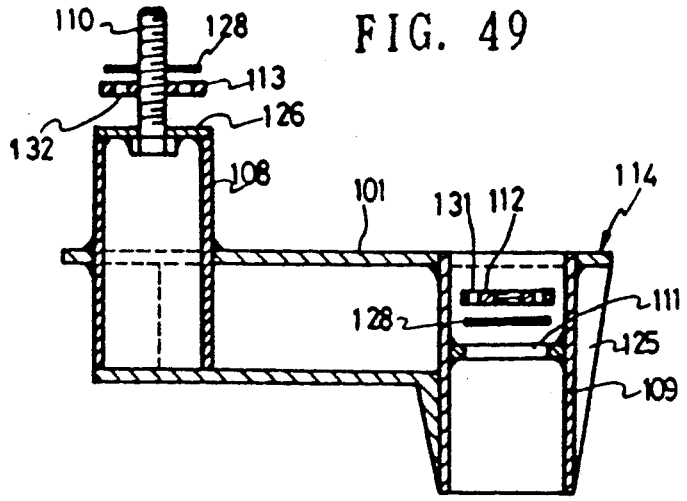
FIG. 49 is a sectional view of FIG. 46, taken along line F—F.
Figure 50:
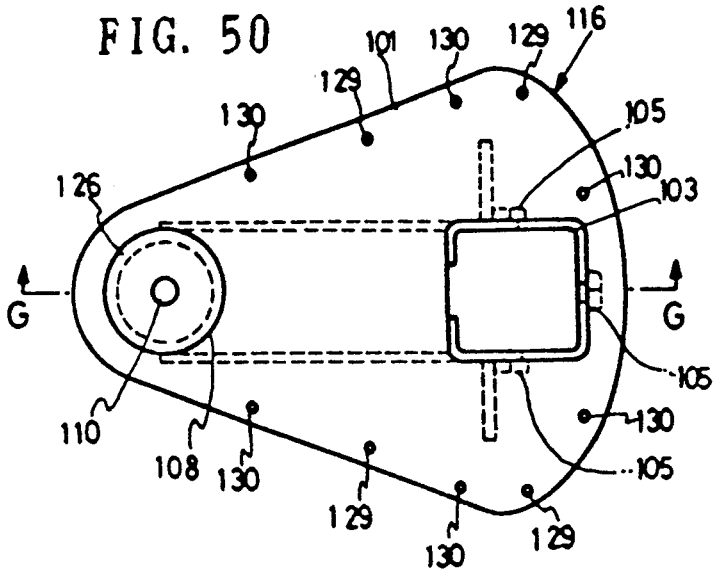
FIG. 50 is a top plan view of stair unit for changing to the straight part from the curved part of the staircase of FIG. 36.
Figure 51:
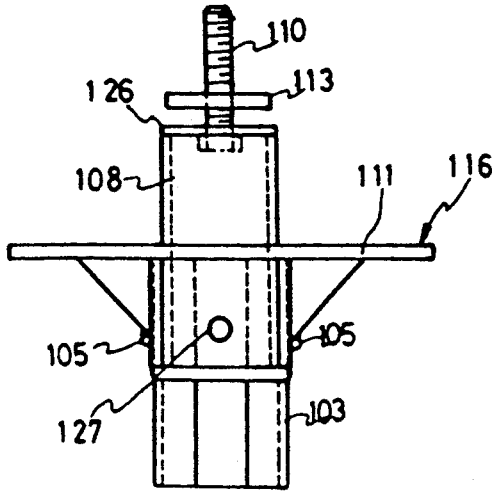
FIG. 51 is a rear elevational view of the stair unit of FIG. 50.
Figure 52:
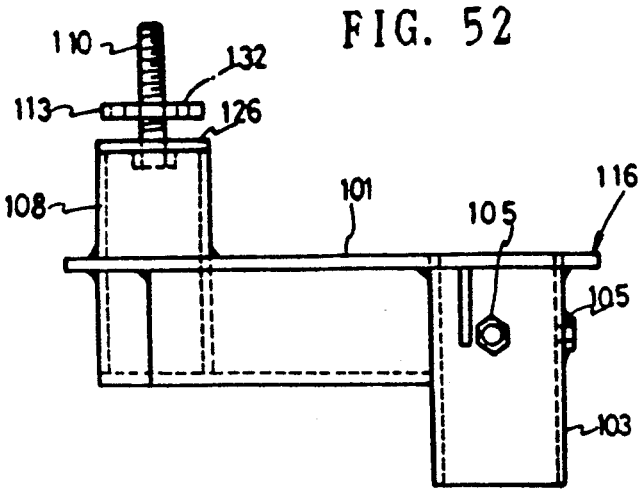
FIG. 52 is a left side elevational view of the stair unit of FIG. 50.
Figure 53:
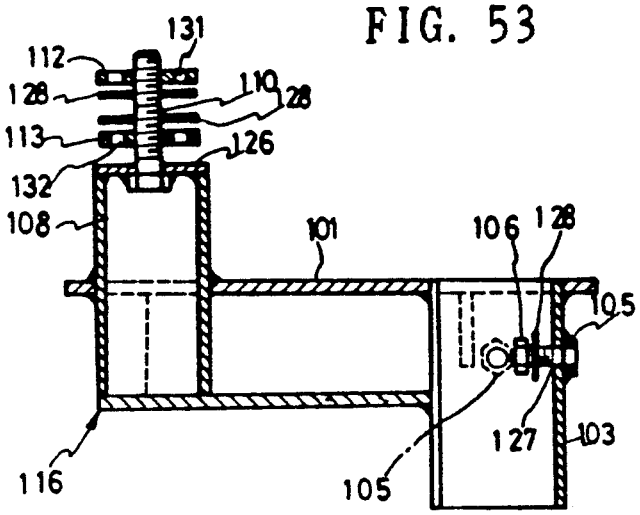
FIG. 53 is a sectional view of FIG. 50, taken along line G—G.
Figure 54:
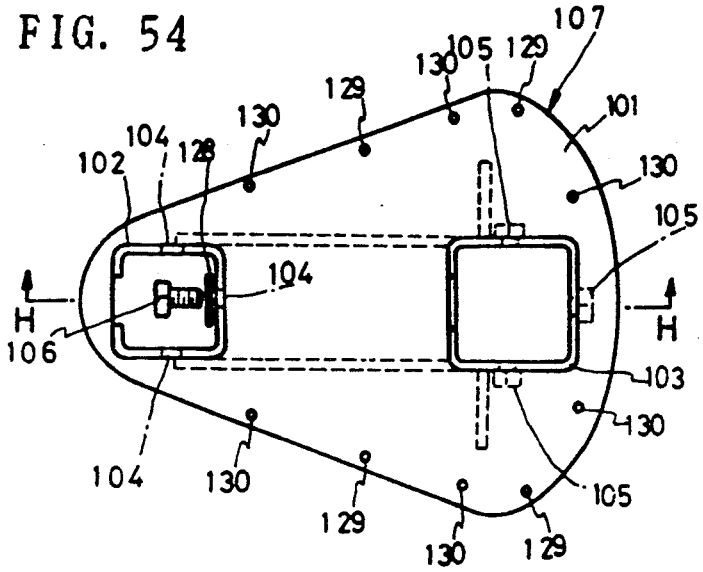
FIG. 54 is a top plan view of the stair unit for the straight part of the staircase of FIG. 50.
Figure 55:
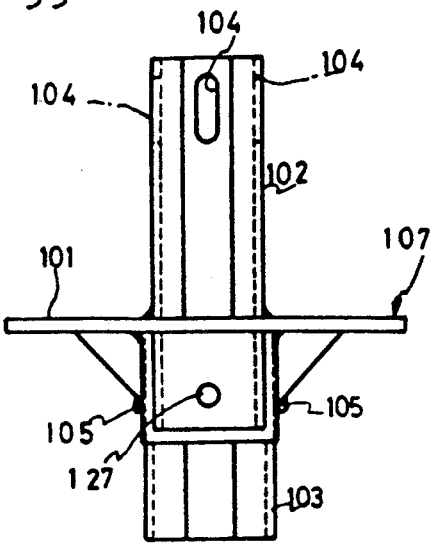
FIG. 55 is a rear elevational view of the stair unit of FIG. 54.
Figure 56:
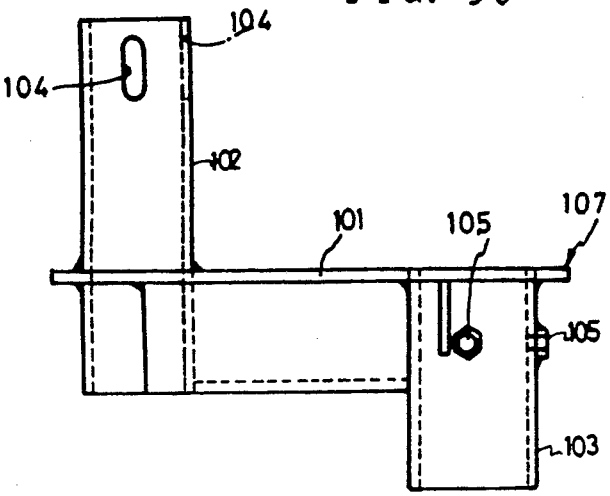
FIG. 56 is a left side elevational view of the stair unit of FIG. 54.
Figure 57:
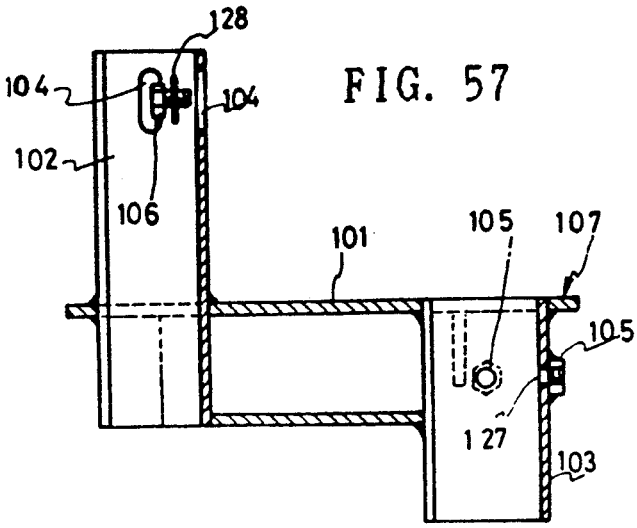
FIG. 57 is a sectional view of FIG. 54, taken along line H—H.
Figure 58:
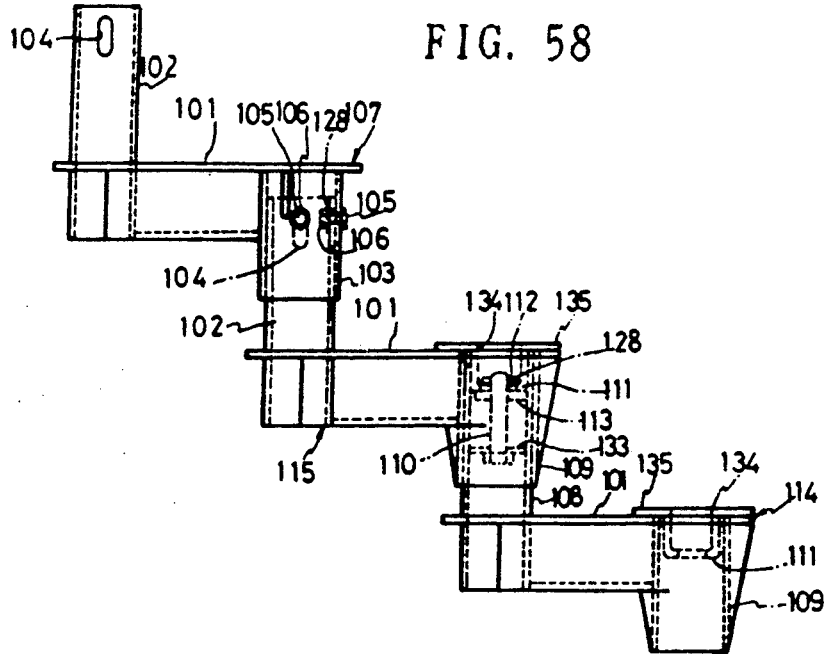
FIG. 58 is a diagrammatic left side elevational view of the assembled staircase according to another second formation of the present invention.
Figure 59:
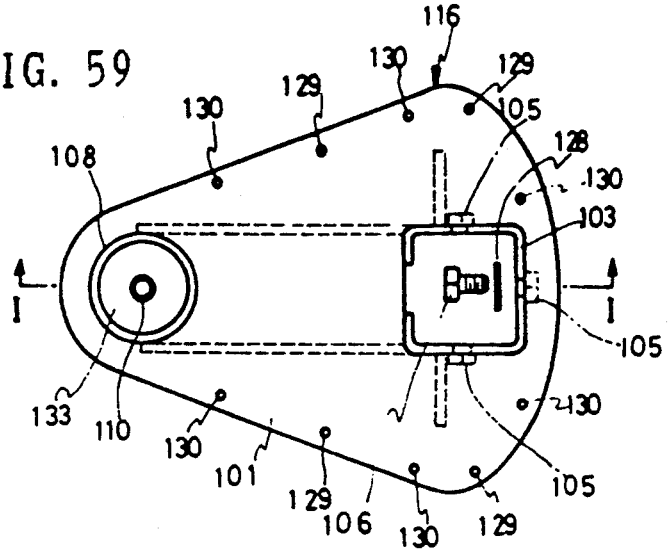
FIG. 59 is a top plan view of the stair unit for changing to the straight part from the curved part of the staircase of FIG. 58.
Figure 60:
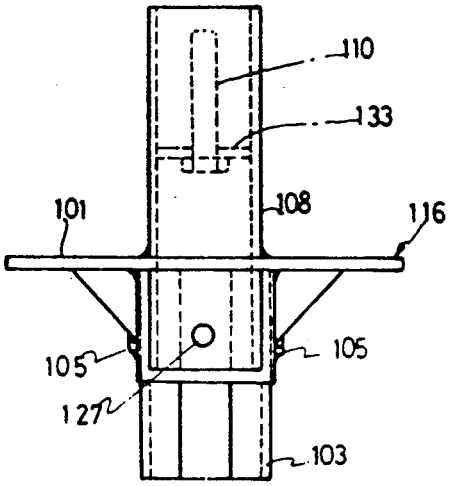
FIG. 60 is a rear elevational view of the stair unit of FIG. 59.
Figure 61:
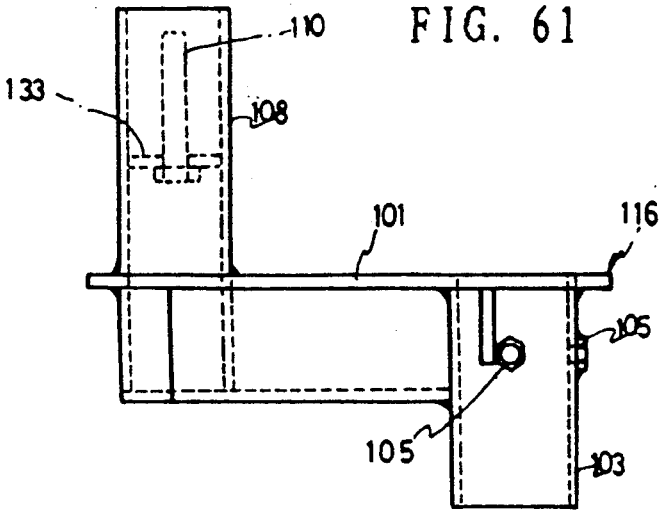
FIG. 61 is a left side elevational view of the stair unit of FIG. 59.
Figure 62:
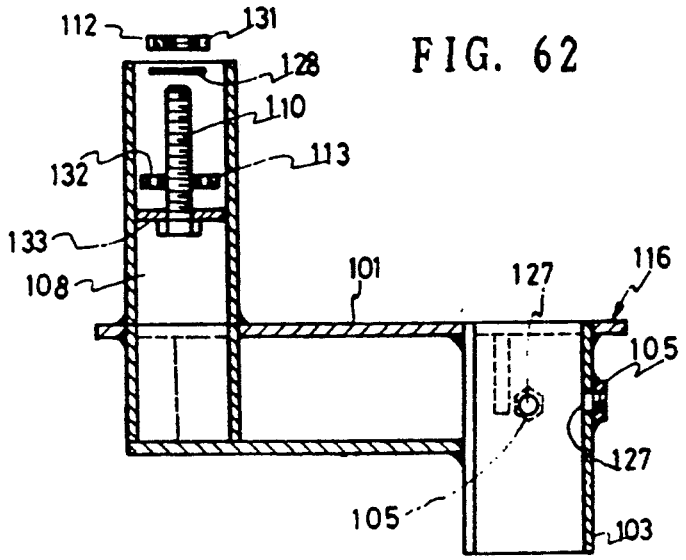
FIG. 62 is a sectional view of FIG. 59, taken along line I—I.
Figure 63:
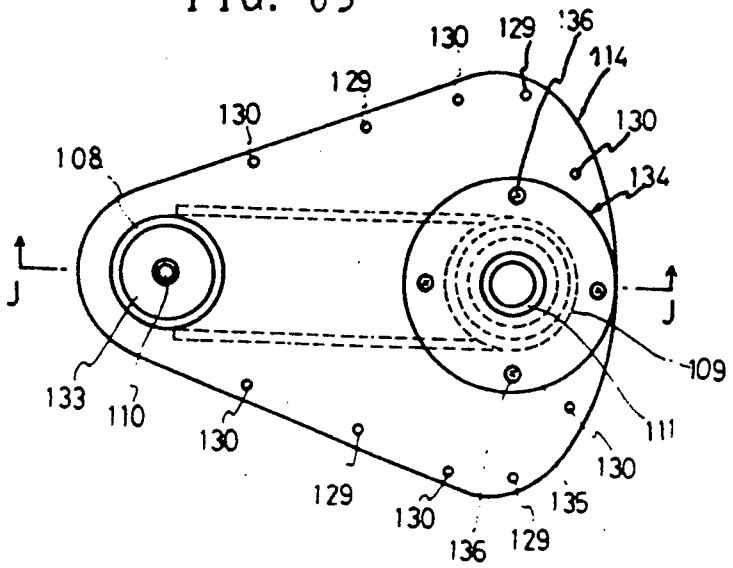
FIG. 63 is a top plan view of the stair unit for the curved part of the staircase of FIG. 58.
Figure 64:
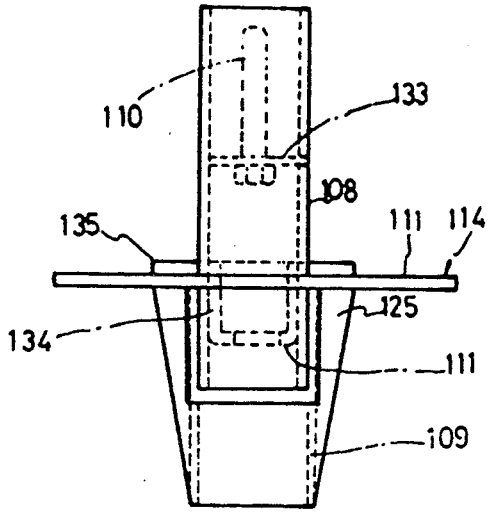
FIG. 64 is a rear elevational view of the stair unit of FIG. 63.
Figure 65:
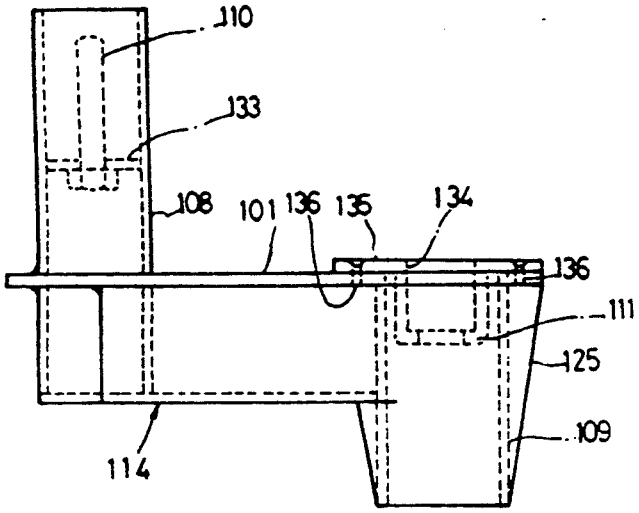
FIG. 65 is a left side elevational view of the stair unit of FIG. 63.
Figure 66:
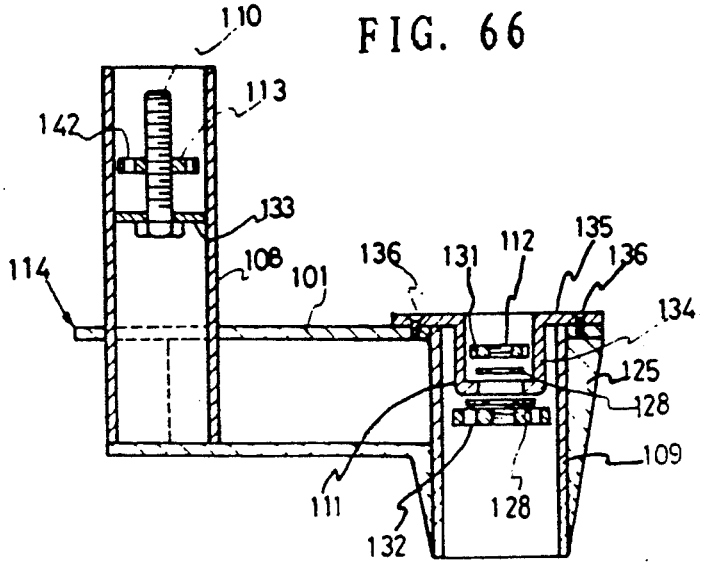
FIG. 66 is a sectional view of FIG. 63, taken along line J—J.
Figure 67:
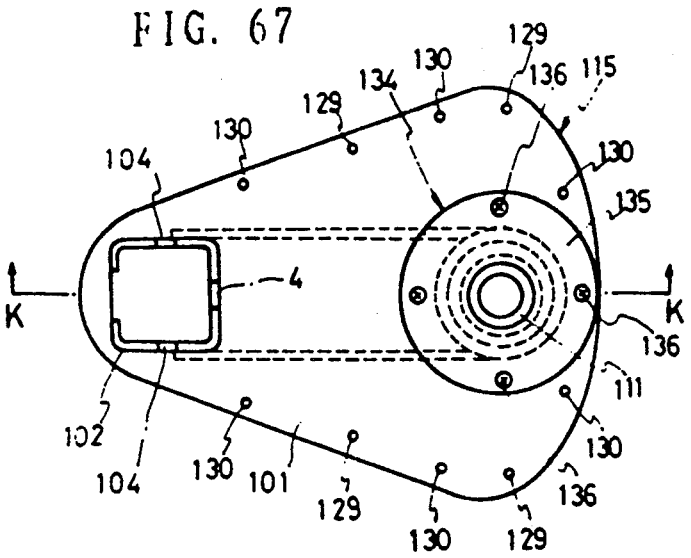
FIG. 67 is a top plan view of the stair unit for changing to the curved part from the straight part of the staircase of FIG. 58.
Figure 68:
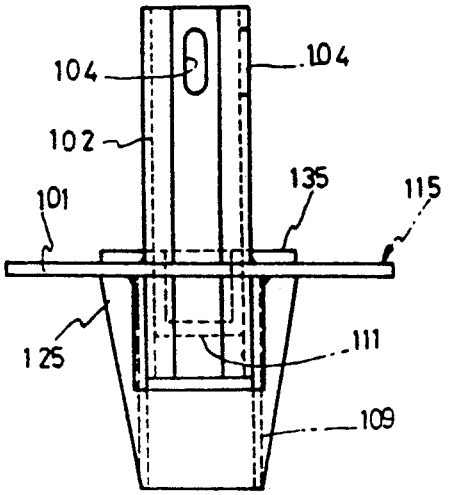
FIG. 68 is a rear elevational view of the stair unit of FIG. 67.
Figure 69:
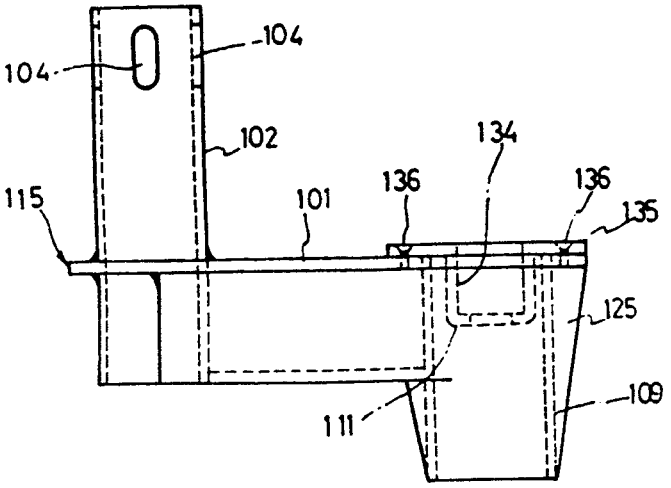
FIG. 69 is a left side elevational view of the stair unit of FIG. 67.
Figure 70:
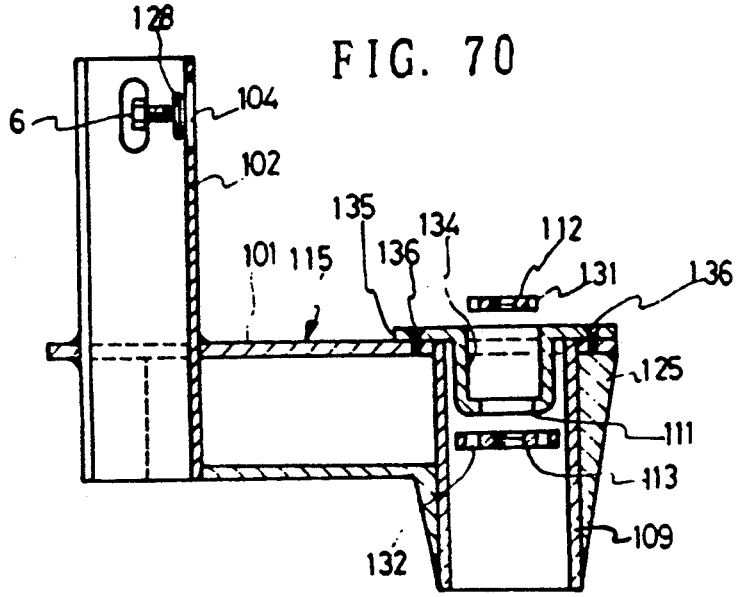
FIG. 70 is a sectional view of FIG. 67, taken along line K—K.

Therefore, downward joint 103 of the second stair unit 107 is inserted into the upward joint 102 of the first stair unit 107 and the upward joint 102 is fixed to the downward joint 103 by tightening the bolt 106 as shown in FIG. 41. The downward joint 103 of the upper stair unit 107 is connected to the upward joint 102 of the lower stair unit 107 and the upward joint 102 is fixed to the downward joint 103 by tightening the bolt 106 and the straight part thereof on the part of the lower floor is thereby fixed upward in consecutive order.

Figure 40:
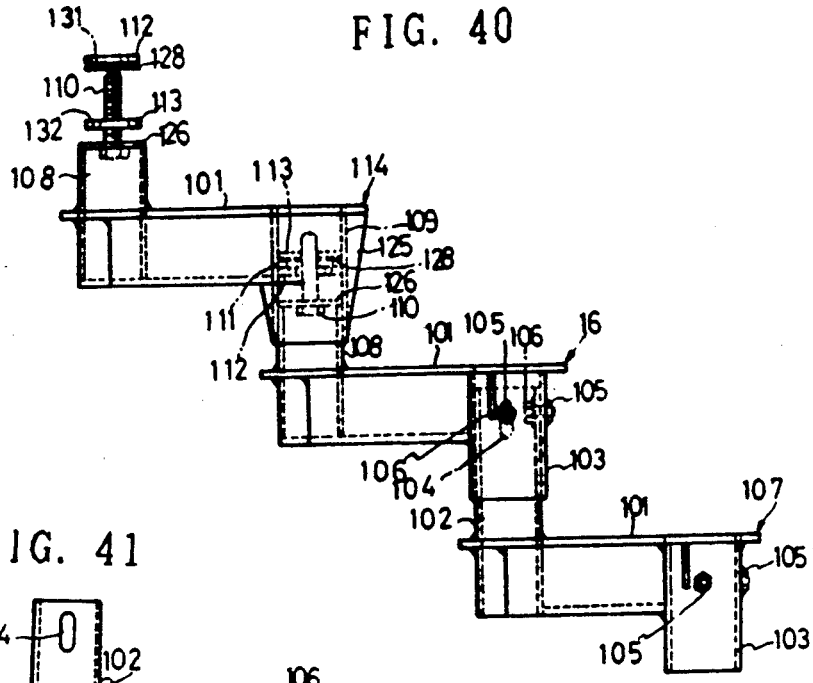
FIG. 40 is a sectional view of the circle V shown in FIG. 36, taken along line C—C illustrating a transferring part from the curved part to the straight part thereof.

Into the upward joint 102 of the topmost stair unit 107 in the straight part thereof, the downward joint 103 of the stair unit 116 used for turning to the curved part thereof for the straight part is inserted and fixed thereto by tightening the bolt 106 (FIG. 40).

Figure 39:
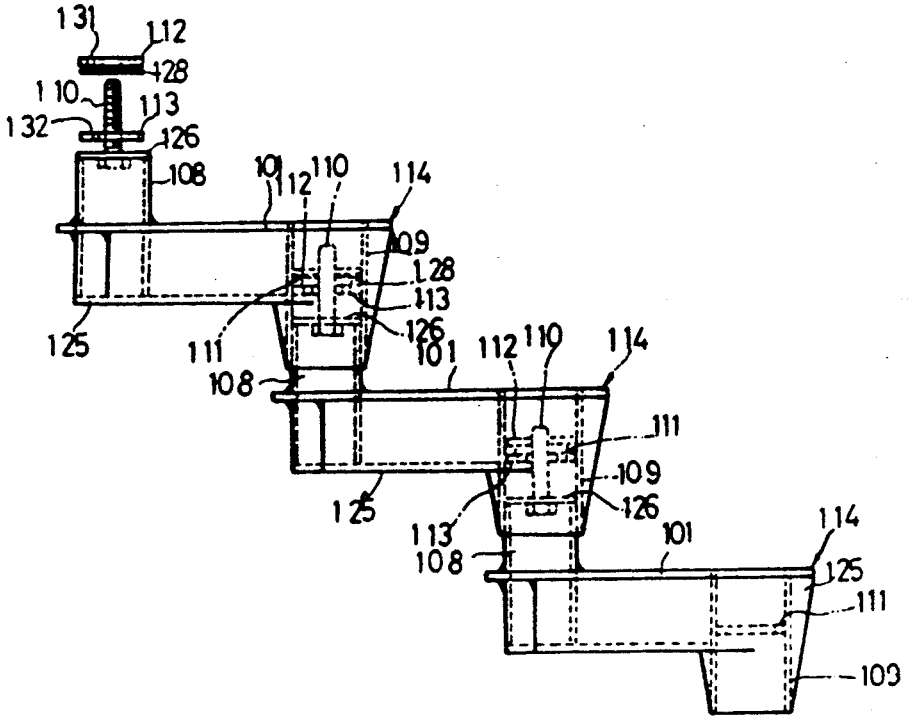
FIG. 39 is a sectional view of the circle IV shown in FIG. 36, taken along line B—B illustrating the curved part thereof.

Into the upward joint 108 of the stair unit 116, the downward joint 109 of the stair unit 114 used for the curved part thereof is inserted and fixed thereto by tightening an upper nut 112 and a lower nut 113. As illustrated in FIG. 39, the downward joint 109 of the upper stair unit 114 is inserted into the upward joint 108 of the lower stair unit 114 and the upward joint 198 is fixed to the downward joint 109 by tightening the upper nut 112 and the lower nut 113 and the curved part thereof is thereby fixed upward in consecutive order.

Figure 38:
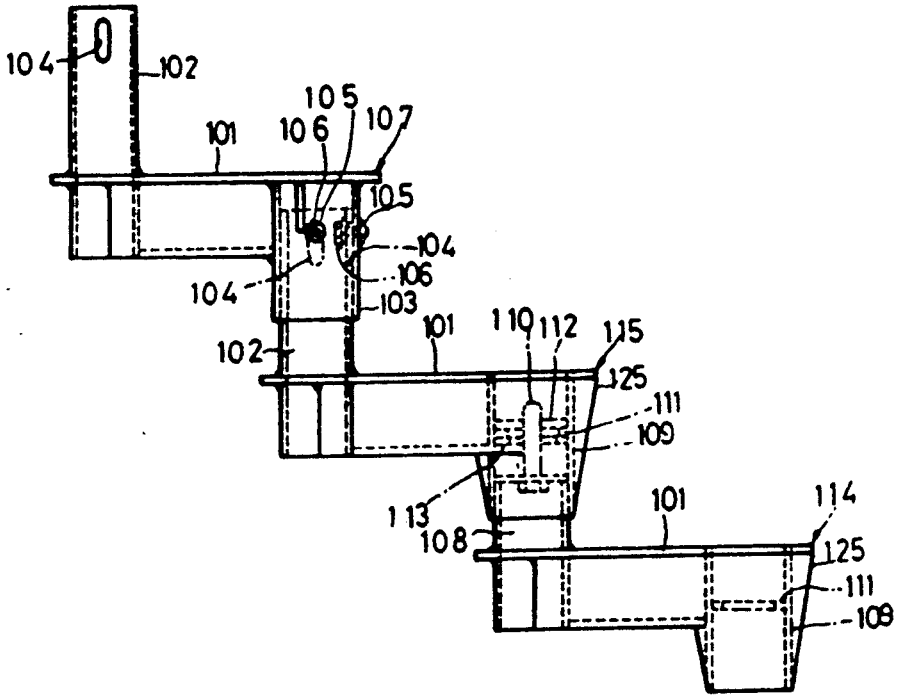
FIG. 38 is a sectional view of the circle III shown in FIG. 36, taken along line A—A illustrating a changing part from a straight part to a curved part thereof.

Into the upward joint 108 of the topmost stair unit 114 in the curved part thereof, the downward joint 109 of the stair unit 115 used for turning to the straight part from the curved part thereof is inserted and fixed thereto by tightening the upper nut 112 and the lower nut 113 as illustrated in FIG. 38.

Into the upward joint 102 of the stair unit 115, the downward joint 103 of the stair unit 107 used for the straight part thereof is inserted and fixed thereto by tightening the bolt 106. As illustrated in FIG. 41, the downward joint 103 of the upper stair unit 107 is inserted into the upward joint 102 of lower stair unit 107 and the upward joint 102 is fixed to the downward joint 103 by tightening the bolt 106. Thus, the upper and lower straight parts thereof are thereby fixed upward in consecutive order.

Into the upward joint 102 of the topmost stair unit 107 in the straight part thereof for the upper story, the downward joint 103 of the top stair unit 117 is inserted and the two joints 102 and 103 are fixed by tightening the bolt 106. The installing plate 122 fixed at the rear end of the horizontal base plate 101 of the top stair unit 117 is fixed to the floor of the upper story by a screw 123.

As the upward and downward joints 102 and 103 of upper and lower stair units 107 and 107 are inserted and united unrotatably in the straight part thereof for the upper story and in the straight part for the lower story, the arrangement angle in the horizontal plane between the upper and lower stair units 107 and 108 cannot be changed.

As the upward joint 102 and the downward joint 103 are inserted and secured unrotatably even between the stair unit for base part 118 and the stair unit for straight part 107 thereof, the arrangement angle of both stair units cannot be changed.

As the downward joint 103 and the upward joint 102 are inserted and secured unrotatably even between the stair unit for top part 117 and the stair unit for straight part 107 thereof, the arrangement angle of both stair units cannot be changed.

As the upward joint 102 and the downward joint 103 are inserted and secured unrotatably even between the stair unit for the straight part 107 and the stair unit for the changing part 116 thereof, the arrangement angle of both stair units cannot be changed.

As the upward joint 102 and the downward joint 103 are inserted and secured unrotatably even between the stair unit for straight parts 107 and 107 thereof, the arrangement angle of both stair units cannot be changed.

However, in the curved part, the upward and downward joints 108 and 109 of upper and lower stair units 114 and 114 are rotatably inserted and secured. Therefore, the arrangement angle in the horizontal plane between the upper and lower stair units 114 and 114 is changeable consecutively.

As the upward joint 108 and the downward joint 109 are rotatably inserted and secured even between the stair unit for the changing part 116 and the stair unit for the curved part 114 thereof, the arrangement angle of both stair units is changeable.

As the upward joint 108 and the downward joint 109 are inserted and secured rotatably even between the stair unit for the curved part 114 and the stair unit for the changing part 115 thereof, the arrangement angle of both stair units is changeable consecutively.

The height between the stair unit for the base part 118 and the stair unit for the straight part 107 thereof is adjustable by means of free length between the longitudinal elongated hole 104 and the bolt 106.

The height between the upper and lower stair units 107 and 107 in the straight part thereof for the lower story is adjustable for every flight or several flights or a particular flight by means of free length between the longitudinal elongated hole 104 and the bolt 106.

The height between the stair unit for the straight part 107 and the stair unit for the changing part 116 thereof is adjustable by means of free length between the longitudinal elongated hole 104 and the bolt 106.

The height between the stair unit for changing part 116 and the unit for curved part 114 thereof is adjustable by moving up and down the spirally uniting position of the upper nut 112 and the lower nut 113 with the fixing bolt 110.

The height between the upper and lower stair units 114 and 114 is adjustable for every flight or several flights or for a particular flight by moving up and down the spirally securing position of the upper nut 112 and the lower nut 113 with the fixing bolt 110.

The height between the stair unit for the curved part 114 and the stair unit for the changing part 116 is adjustable by moving up and down the spirally securing position of the upper nut 112 and the lower nut 113 with the fixing bolt 110.

The height between the stair unit for the changing part 115 and the stair unit for the straight part 107 thereof is adjustable by means of free length between the longitudinal elongated hole 104 and the bolt 106.

The height between the upper and lower stair units 107 and 107 in the straight part for the upper story is adjustable for every flight or several flights or for the particular flight by means of free length between the longitudinal elongated hole 104 and the bolt 106.

The height between the stair unit for the straight part 107 and the stair unit for the top part 117 thereof is adjustable by means of free length between the horizontal elongated hole 104 and the bolt 106.

In this way, a straight staircase provided with the landing or the curved staircase which has a curved part or is curved in its main part is built by properly fixing up the stair unit 107 for the straight part, the stair unit 114 for the curved part, the stair unit 115 for the changing part and the stair unit 116 for the changing part and using them together with the stair unit 117 for the top part and the stair unit 118 for base part. To the horizontal base plate 101 of each stair unit of the tread 119 is fixed.

The third formation according to the present invention is assembled as follows:

The portable, assemblable-disassemblable staircase according to the present invention can be fixed up to the upper story from the lower story or to the lower story from the upper story.

Figure 72:
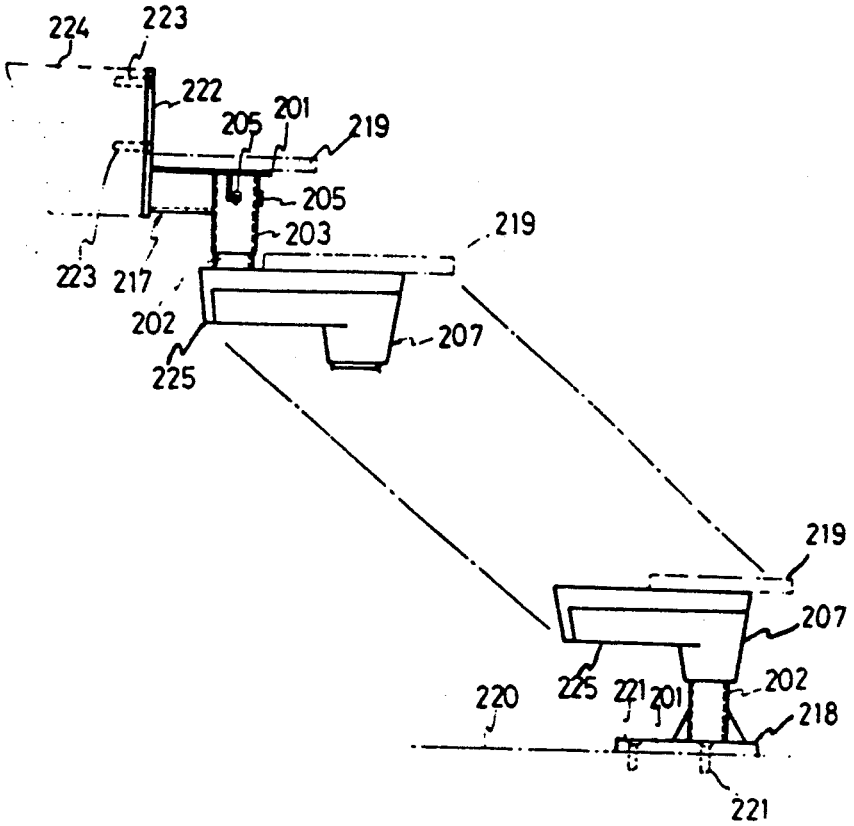
FIG. 72 is a diagrammatic left side elevational view of the staircase of FIG. 71.

In case it is fixed up from the lower floor to the upper floor, for example, the horizontal base plate 201 of the stair unit 218 for the base part thereof is fixed to the lower floor by tightening a screw 211, as illustrated in FIG. 72.

Figure 71:
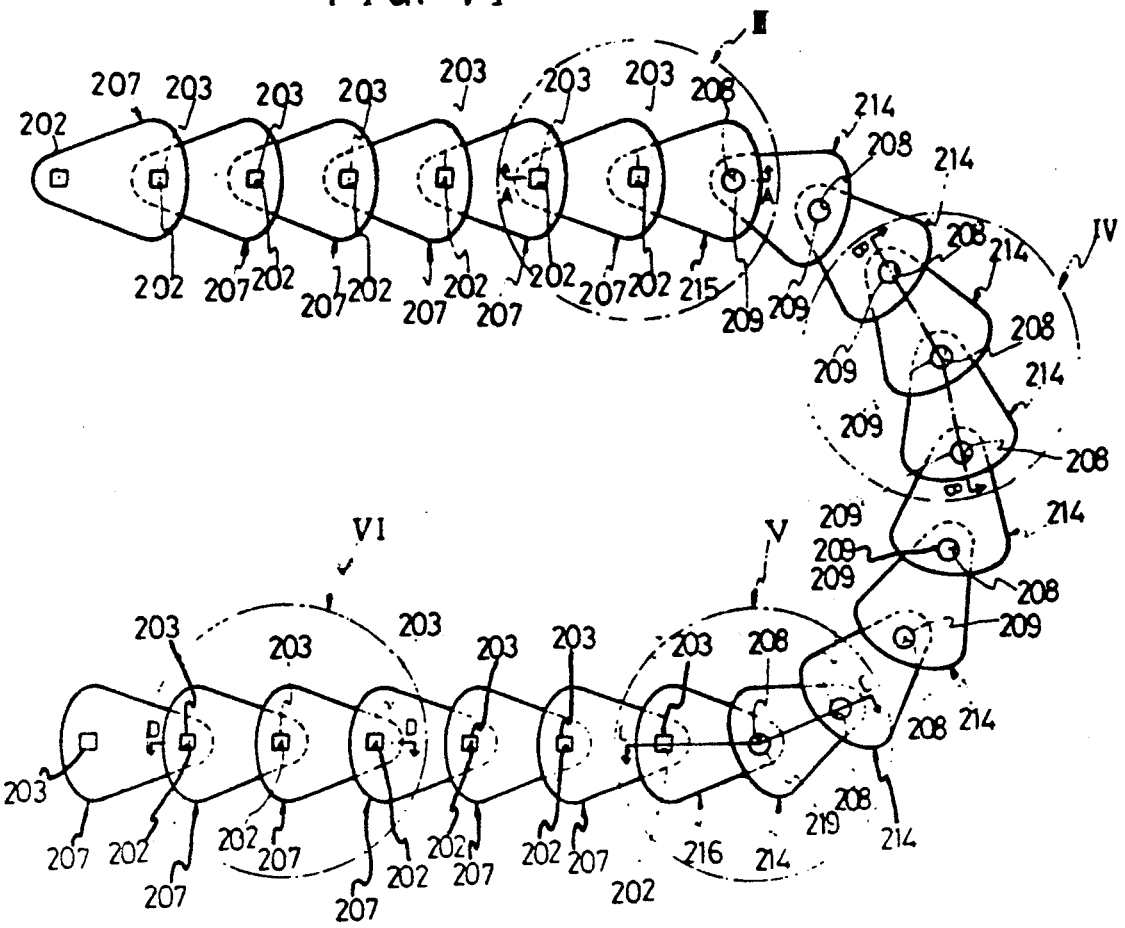
FIG. 71 is a diagrammatic top plan view of the staircase according to a third formation of the present invention.

When the straight part between the upper and lower floors is formed of a stair unit 207 and the curved part like a landing part is formed of a stair unit 214 as illustrated in FIG. 71, the downward joint 203 of the first stair unit 207 for the straight part is inserted and secured with the upward joint 202 of the stair unit 218 for the base part and the upward joint 202 is fixed to the downward joint 203 by tightening the bolt 206 (FIG. 72). The bolt 206 and a driving tool are inserted from the upper open parts of the upward joint 202 and downward joint 203.

Figure 76:
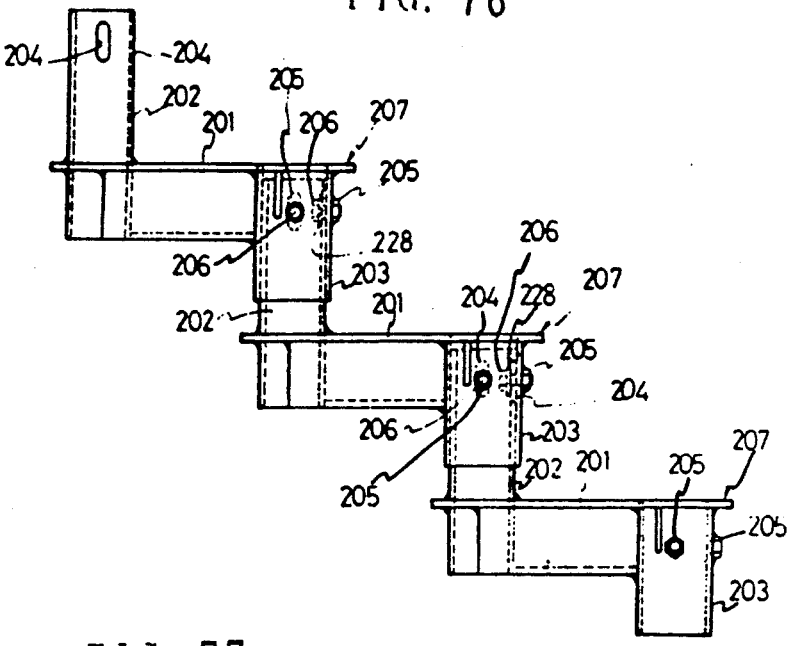
FIG. 76 is a sectional view of the circle VI shown in FIG. 71, taken along line D—D illustrating the straight part thereof.
Figure 77:
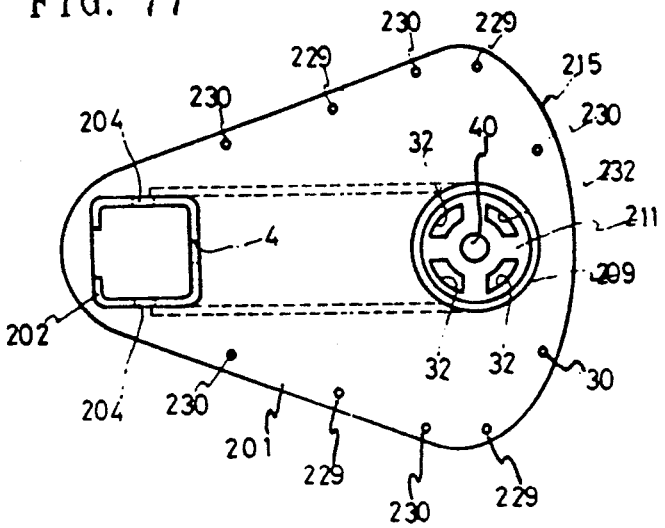
FIG. 77 is a top plan view of the stair unit for changing from the straight part to the curved part of the staircase according to the third formation of the present invention.
Figure 78:
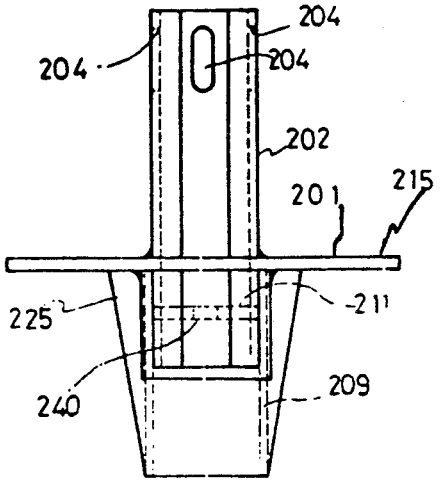
FIG. 78 is a rear elevational view of the stair unit of FIG. 77.
Figure 79:
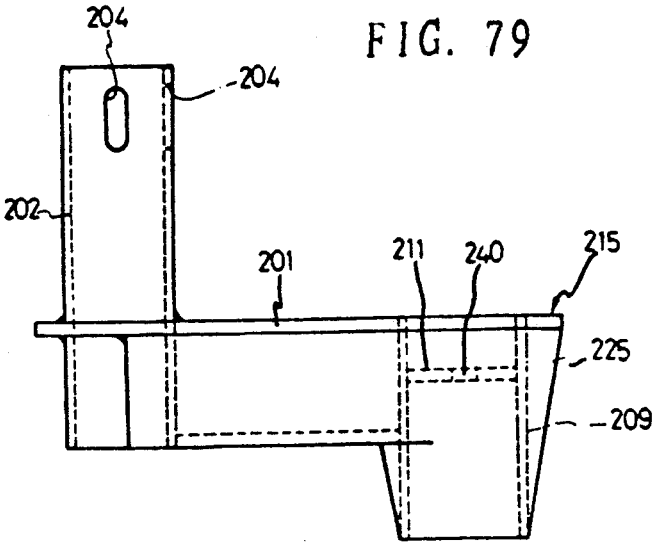
FIG. 79 is a left side elevational view of the stair unit of FIG. 77.
Figure 80:
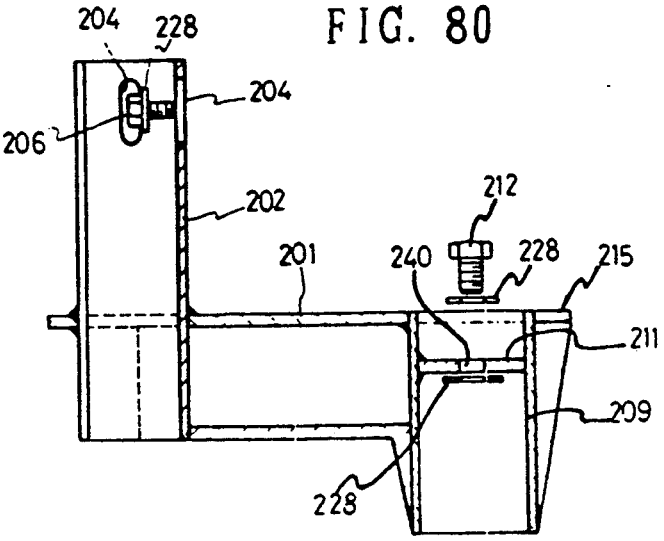
FIG. 80 is a sectional view of FIG. 77, taken along line E—E.
Figure 81:
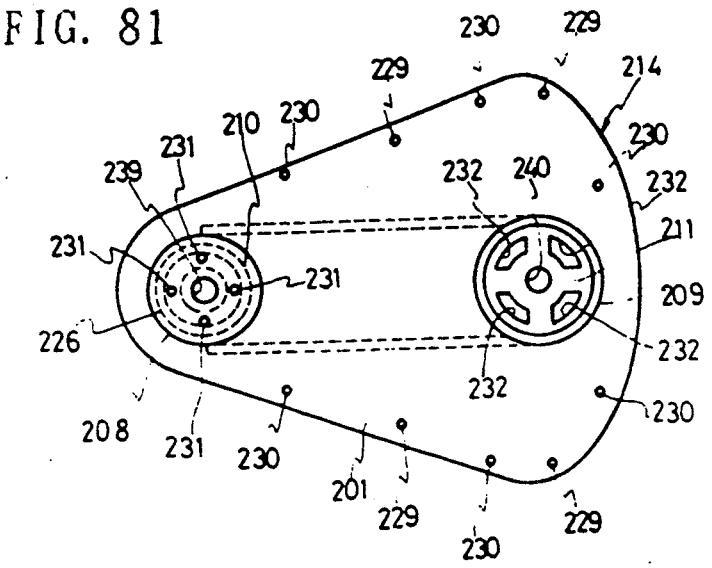
FIG. 81 is a top plan view of the stair unit for the curved part of the staircase to the third formation of the present invention.
Figure 82:
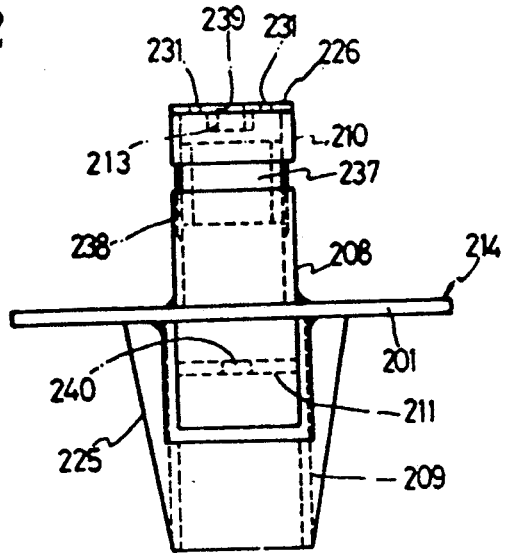
FIG. 82 is a rear elevational view of the stair unit of FIG. 81.
Figure 83:
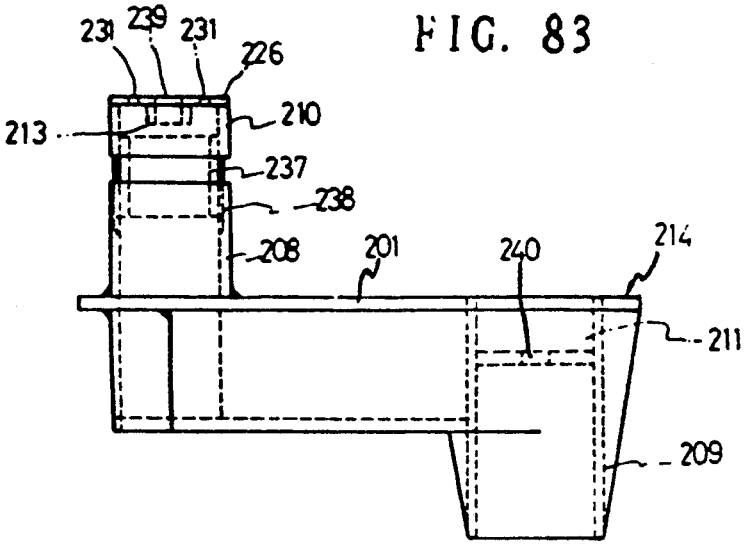
FIG. 83 is a left side elevational view of the stair unit of FIG. 81.
Figure 84:
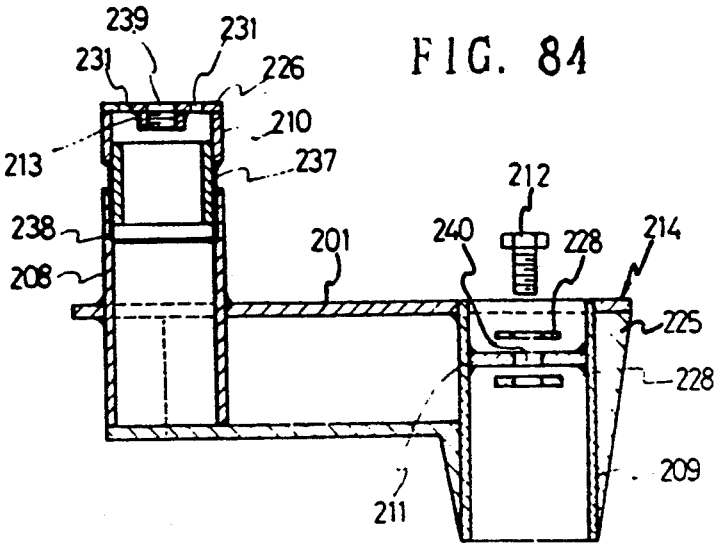
FIG. 84 is a sectional view of FIG. 81, taken along line F—F.
Figure 85:
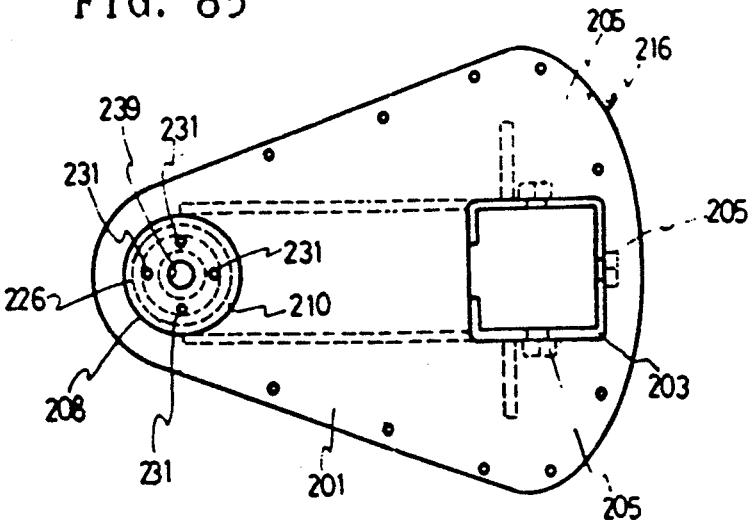
FIG. 85 is a top plan view of the stair unit for changing to the straight part from the curved part of the staircase according to the third formation of the present invention.
Figure 86:
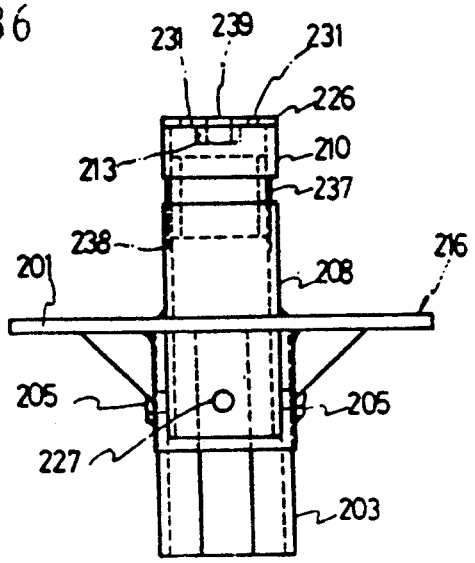
FIG. 86 is a rear elevational view of the stair unit of FIG. 85.
Figure 87:
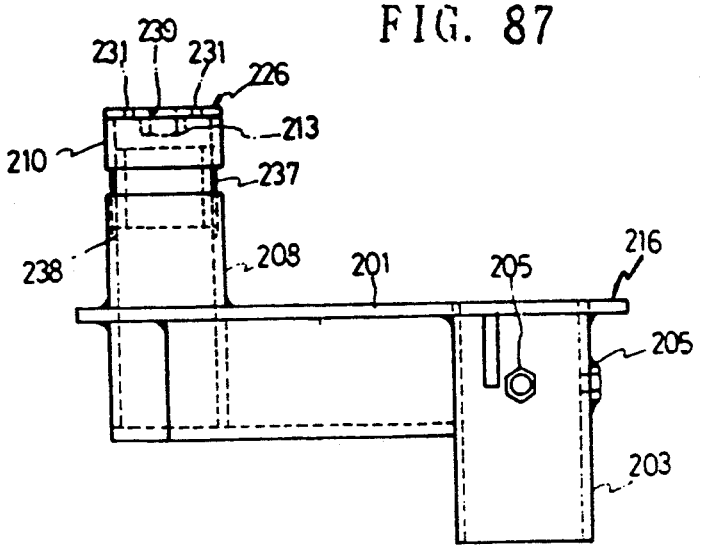
FIG. 87 is a left side elevational view of the stair unit of FIG. 85.
Figure 88:
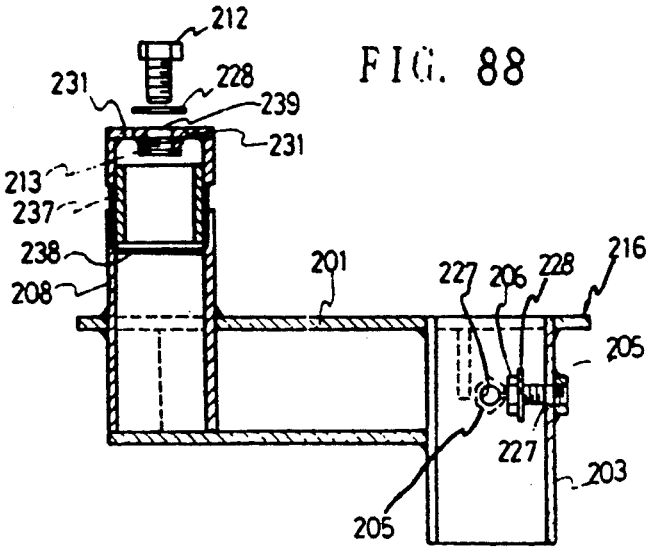
FIG. 88 is a sectional view of FIG. 85, taken along line G—G.
Figure 89:
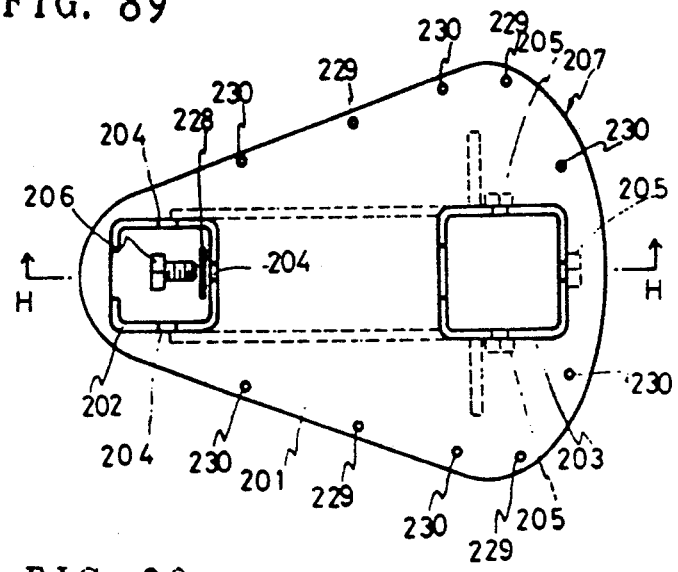
FIG. 89 is a top plan view of the stair unit for the straight part of the staircase according to the third formation of the present invention.
Figure 90:
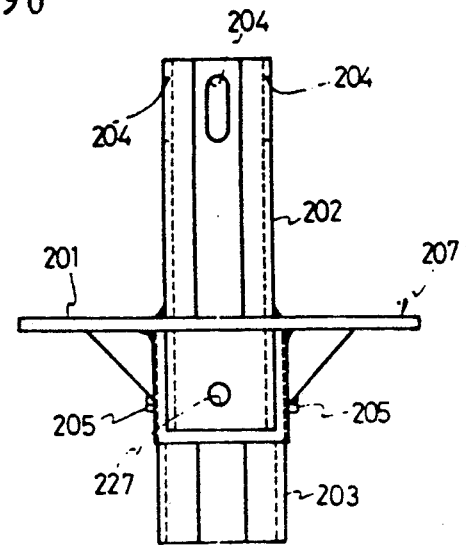
FIG. 90 is a rear elevational view of the stair unit of FIG. 89.
Figure 91:
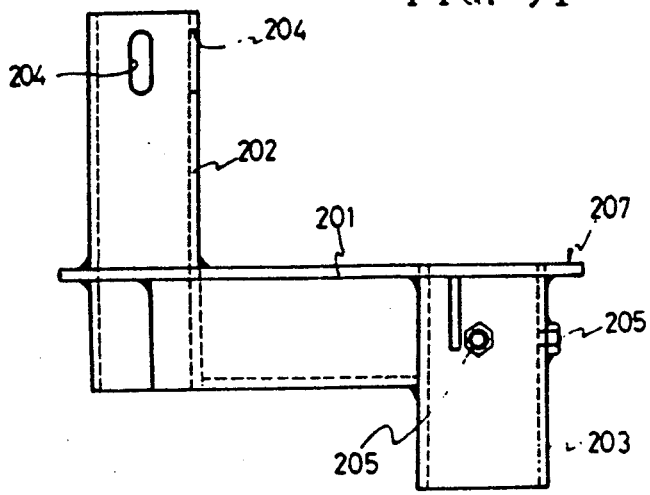
FIG. 91 is a left side elevational view of the stair unit of FIG. 89.
Figure 92:
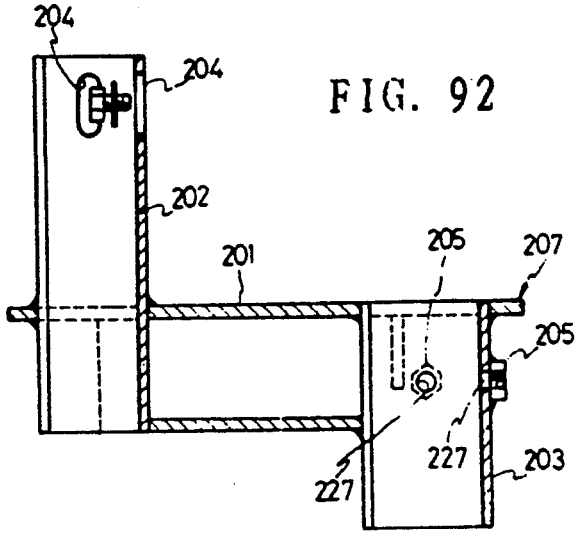
FIG. 92 is a sectional view of FIG. 89, taken along line H—H.
Figure 93:
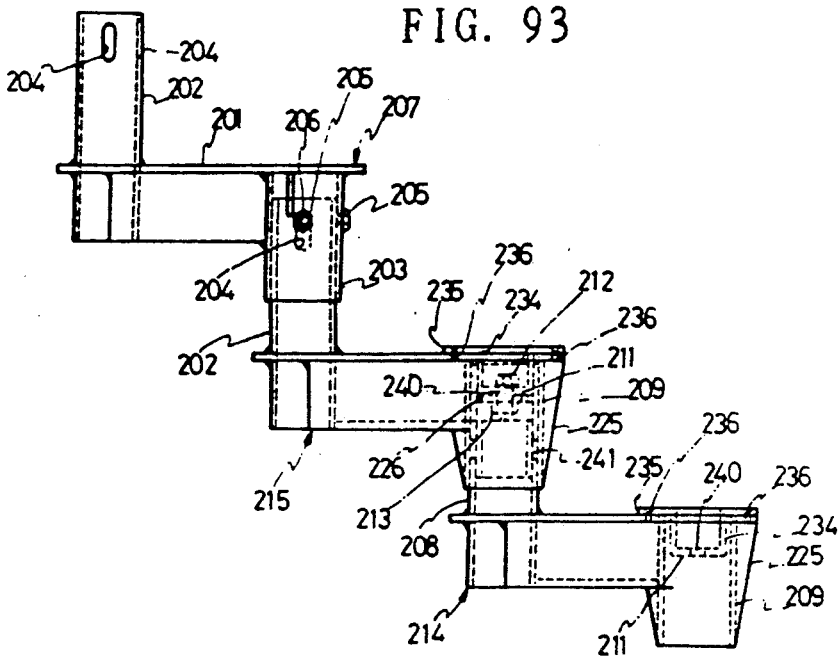
FIG. 93 is a diagrammatic left side elevational view of the assembled staircase according to another third formation of the present invention.
Figure 94:
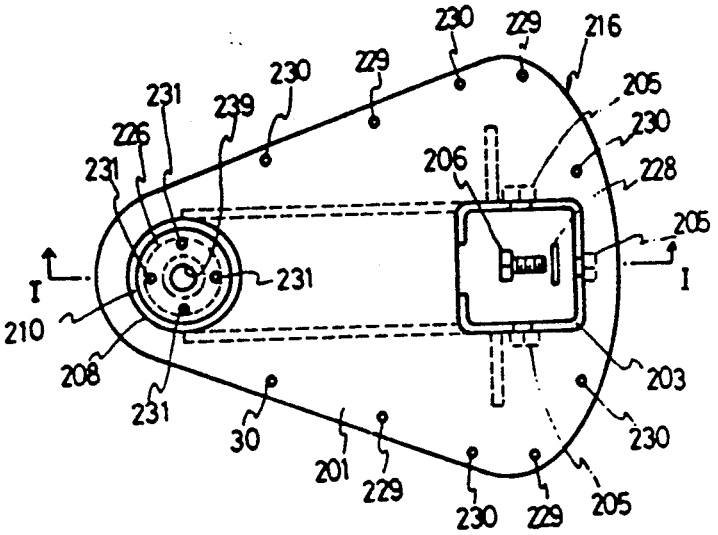
FIG. 94 is a top plan view of the stair unit for changing from the curved part to the straight part of the staircase of FIG. 93.
Figure 95:
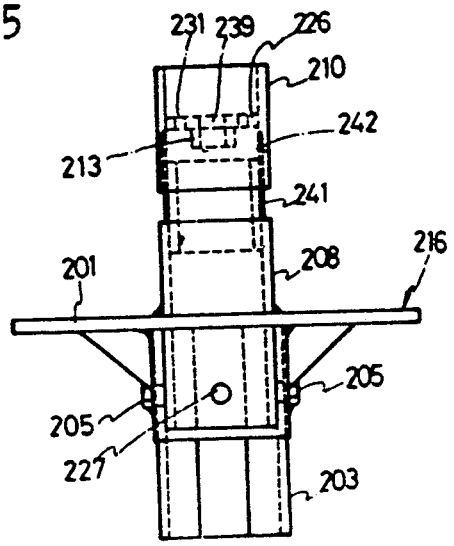
FIG. 95 is a rear elevational view of the stair unit of FIG. 94.
Figure 96:
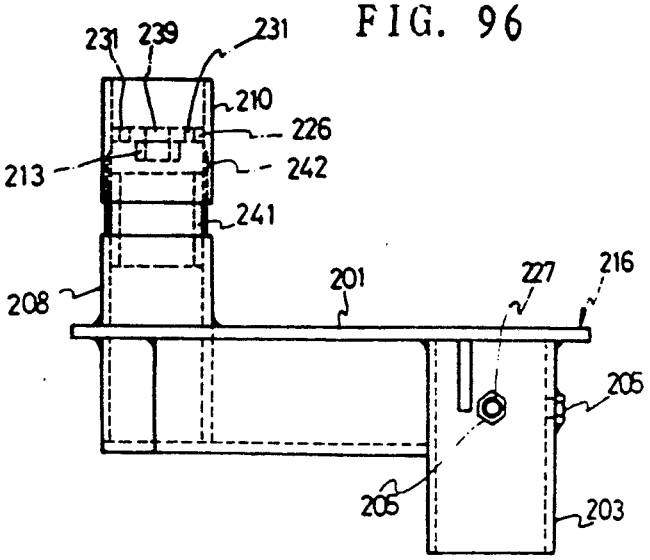
FIG. 96 is a left side elevational view of the stair unit of FIG. 94.
Figure 100:
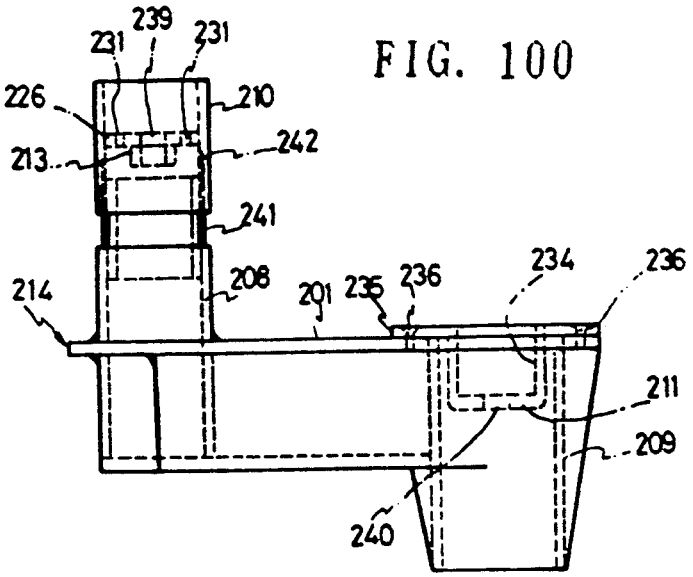
FIG. 100 is a left side elevational view of the stair unit of FIG. 98.
Figure 101:
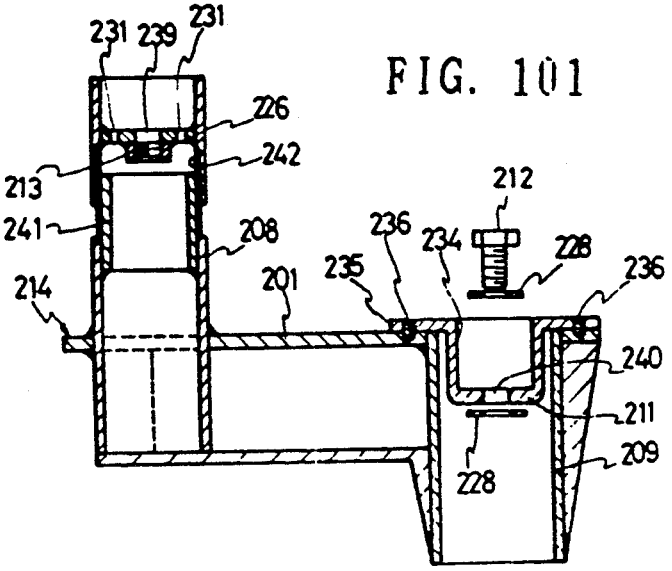
FIG. 101 is a sectional view of FIG. 98, taken along line J—J.
Figure 102:
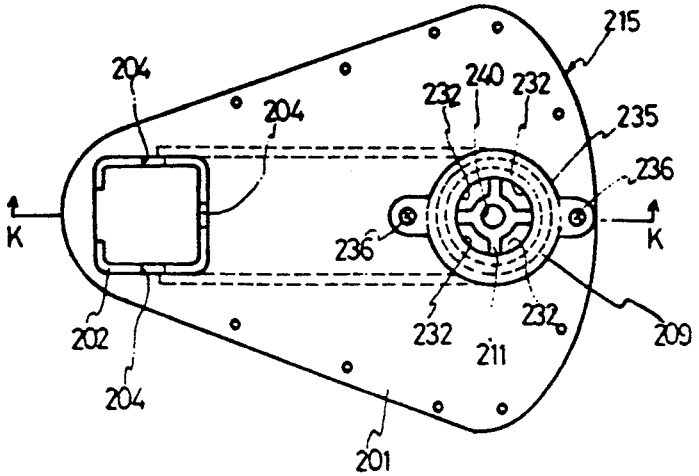
FIG. 102 is a front elevational view of the stair unit for changing from the straight part to the curved part of the staircase according to another third formation.
Figure 103:
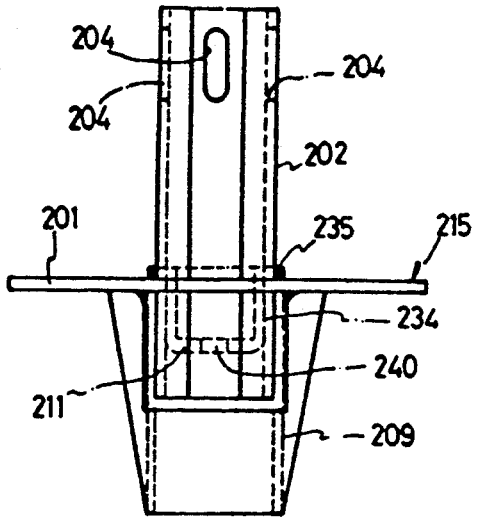
FIG. 103 is a rear elevational view of the stair unit of FIG. 102.
Figure 104:
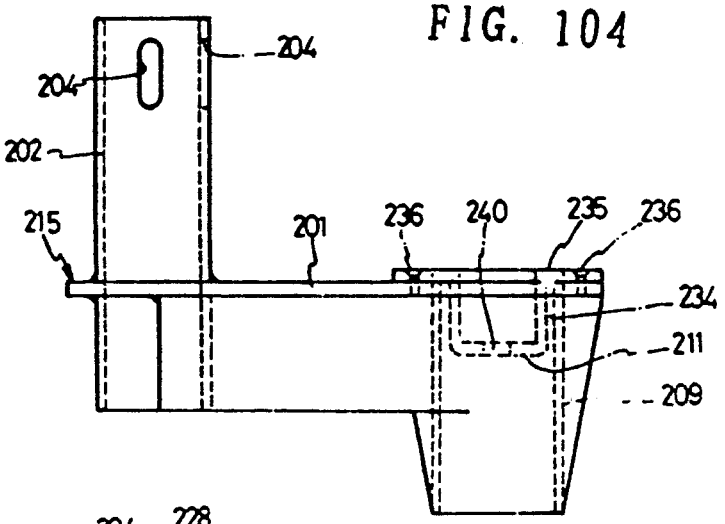
FIG. 104 is a left side elevational view of the stair unit of FIG. 102.
Figure 105:
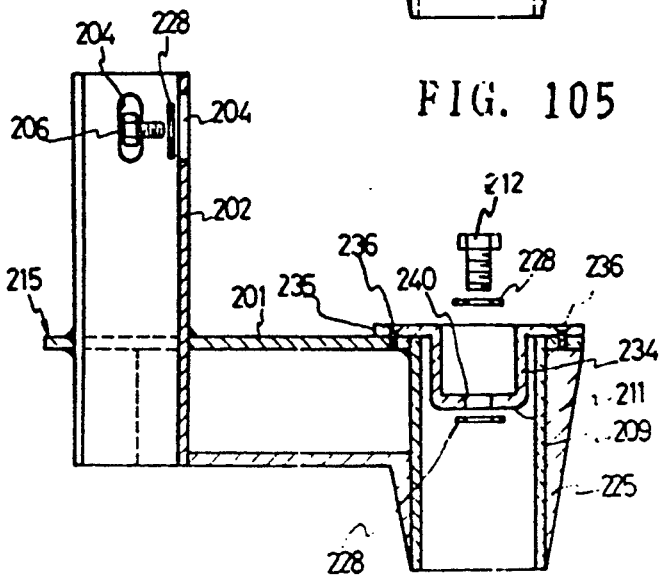
FIG. 105 is a sectional view of FIG. 12, taken along line K—K.

As illustrated in FIG. 76, the downward joint 203 of the second stair unit 20 is inserted and secured with the upward joint 202 of the first stair unit 207 and the upward joint 202 is fixed to the downward joint 203 by tightening the bolt 206.

In this way, the straight part for the lower story is fixed up in consecutive order by securing the downward joint 203 of upper stair unit 207 with the upward joint 202 of the lower stair unit 207 and fixing the upward joint 202 to the downward joint 203 with the bolt 206.

Figure 75:
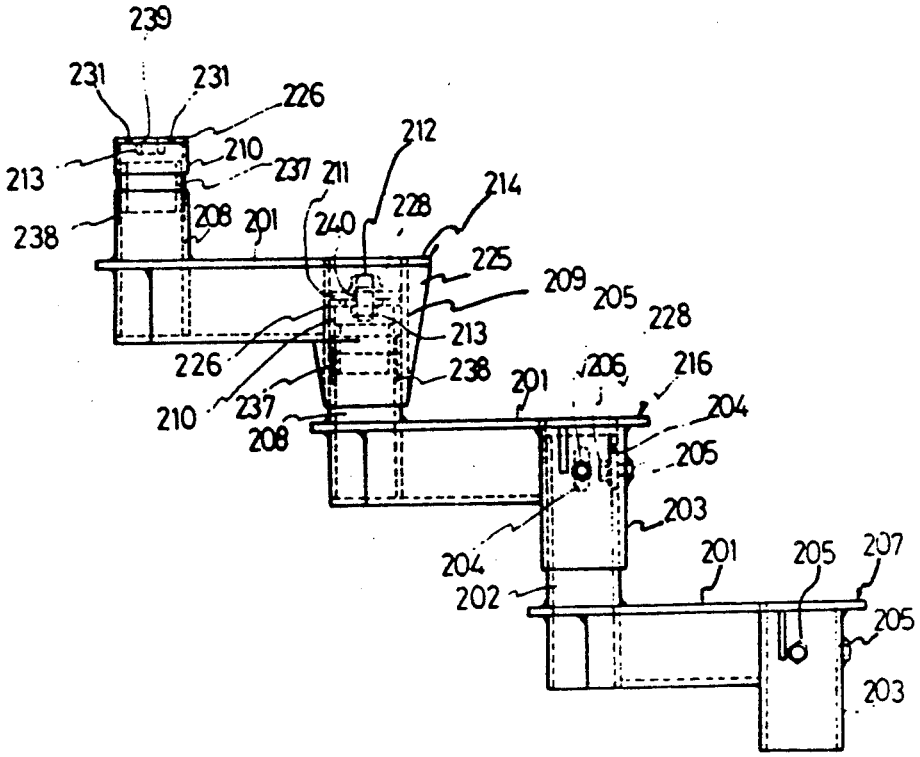
FIG. 75 is a sectional view of the circle V shown in FIG. 71, taken along line C—C illustrating the changing part from the curved part thereof.

Into the upward joint 202 of the topmost stair unit 207 in the straight part, the downward joint 203 of the stair unit 216 for changing from the straight part to the curved part is inserted and fixed thereto by tightening the bolt 206 (FIG. 75).

Into the upward joint 298 of the stair unit 216, the downward joint 209 of the stair unit 214 for the curved part thereof is inserted and fixed thereto by a bolt 212 and a nut 213.

Figure 74:
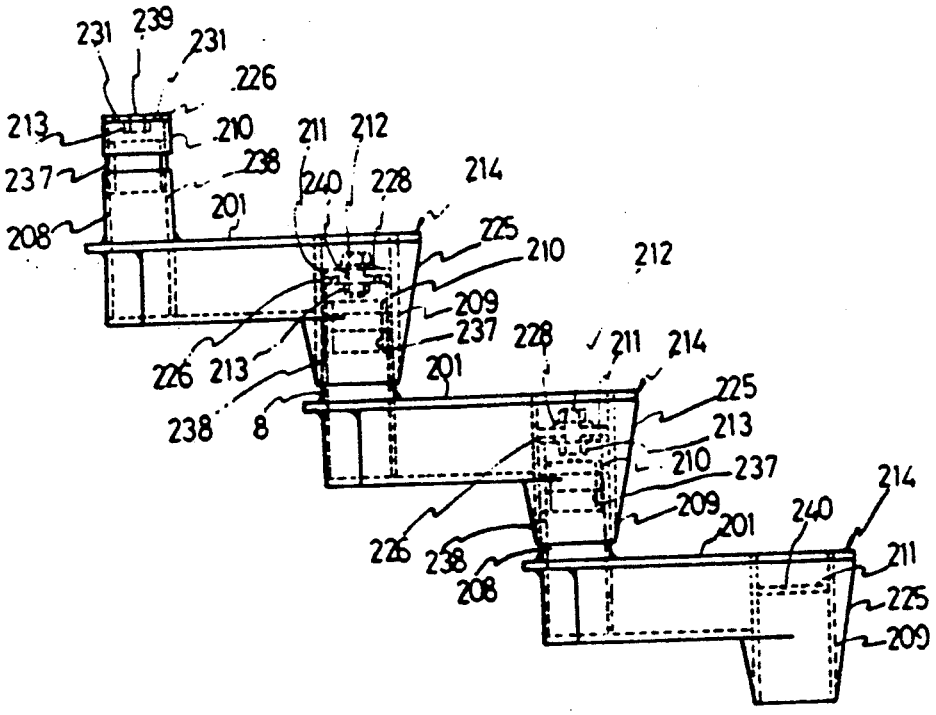
FIG. 74 is a sectional view of the circle IV shown in FIG. 71, taken along line B—B illustrating the curved part thereof.

As shown in FIG. 74, the curved part is fixed up in consecutive order by securing the downward joint 209 of upper stair unit 214 with the upward joint 208 of the lower stair unit 214 and fixing the upward joint 208 to the downward joint 209 with the bolt 209 and the nut 213.

Figure 73:
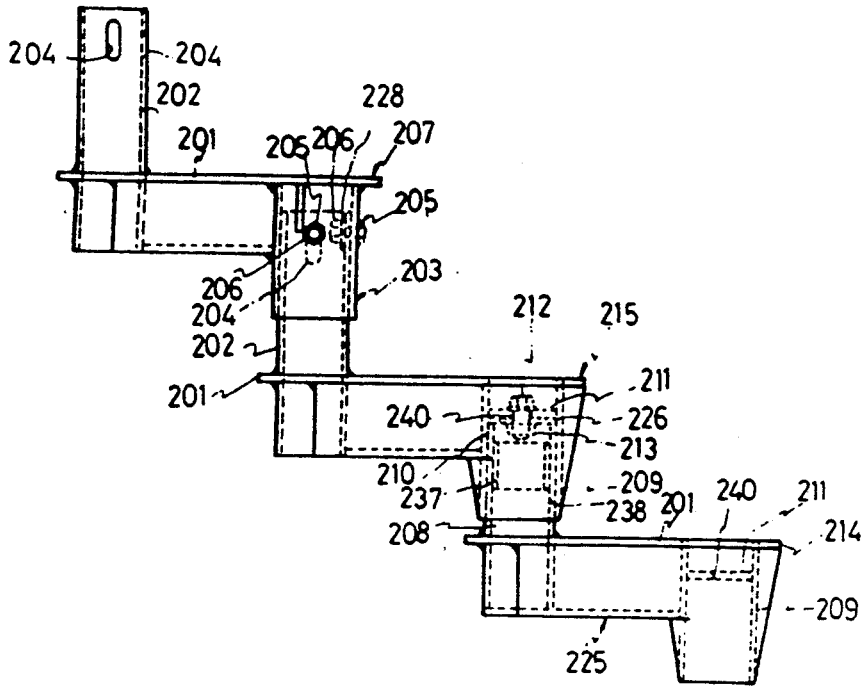
FIG. 73 is a sectional view of the circle III shown in FIG. 71, taken along line A—A, illustrating the curved part from the straight part thereof.

Into the upward joint 208 of the topmost stair unit 214 in the curved part, the downward joint 209 of the stair unit 215 for the changing from the curved part to the straight part is inserted and fixed thereto by the bolt 212 and the nut 213 (FIG. 73).

Into the upward joint 202 of the stair unit 215, the downward joint 203 of the stair unit 207 for the straight part is inserted and fixed thereto by the bolt 206.

As illustrated in FIG. 76, the straight part for the upper floor is fixed up in consecutive order by securing the downward joint 203 of upper stair unit 207 with the upward joint 203 of the upper stair unit 207 with the upward joint 202 of the lower stair unit 207 and fixing the upward joint 202 to the downward joint 203 with the bolt 206.

Into the upward joint 202 of the topmost stair unit 207 in the straight part for the upper floor, the downward joint 203 of the stair unit 217 for the top part thereof is inserted and the upward joint 202 is fixed to the downward joint 203 by tightening the bolt 206.

Thereafter, the installing plate 222 fixed to the base end of the horizontal base plate 201 of the stair unit 217 for the top part thereof is fixed to the floor of the upper story by a screw 223.

In the straight part for the upper story and in the straight part for the lower story, the upward and downward joints 202 and 203 of the upper and lower stories 207 and 207 are inserted and fixed unrotatably. Therefore, the arrangement angle in the horizontal plane between the upper and lower stair units 207 and 207 is unchangeable.

As the upward joint 202 and the downward joint 203 are inserted and fixed unrotatably even between the stair unit 218 for the base part and the stair unit 207 for the straight part, the arrangement angle of both stair units is unchangeable.

As the downward joint 203 and the upward joint 202 are also inserted and secured unrotatably between the stair unit 217 for the top part and the stair unit 207 for the straight part thereof, the arrangement angle of both stair units is unchangeable.

As the upward joint 202 and the downward joint 203 are also inserted and secured unrotatably between the stair unit 207 for the straight part and the stair unit 216 for the changing part thereof, the arrangement angle of both stair units is unchangeable.

As the upward joint 202 and the downward joint 203 are also inserted and fixed unrotatably between the stair unit 215 the changing part and the stair unit 207 for the straight part thereof, the arrangement angle of both stair units is unchangeable.

In the curved part, the upward and downward joints 208 and 209 of the upper and lower stair units 214 and 214 are inserted and secured rotatably. Thereof, the upper and lower stair units 214 and 214 can change the arrangement angle consecutively in the horizontal plane.

As the upward joint 208 and the downward joint 209 are also inserted and fixed rotatably between the stair unit 216 for the changing part and the stair unit 214 for the curved part thereof, the arrangement angle of both stair units is changeable consecutively.

As the upward joint 208 and the downward joint 209 between the stair unit 214 for the curved part and the stair unit 215 for the changing part thereof are also inserted and secured rotatably, the arrangement angle of both stair units is changeable consecutively.

The height between the stair unit 218 for the base part and the stair unit 207 for the straight part thereof is adjustable by means of free length between the longitudinal elongated hole 204 and the bolt 216.

The height between the upper and lower stair units 207 and 207 in the straight part for the lower story is adjustable for every flight or several flights or for a particular flight by means of free length between the longitudinal elongated hole 204 and the bolt 206.

The height between the stair unit 207 for the straight part and the stair unit 216 for the changing part thereof is adjustable by means of free length between the longitudinal elongated hole 204 and the bolt 206.

The height between the stair unit 216 for the changing part and the stair unit 214 for the curved part thereof is adjustable by moving up and down the spirally fixing position of the movable case 210 with the upward joint 208.

The height between the upper and lower stair units 214 and 214 in the curved part is adjustable for every flight or several flights or for a particular flight by moving up and down the spirally fixing position of the movable case 210 with the upward joint 208.

The height between the stair unit 214 for the curved part and the stair unit 21 for the changing part thereof is adjustable by moving up and down the spirally fixing position of the movable case 210 with the upward joint 208.

The height between the stair unit 215 for the changing part and the stair unit 207 for the straight part thereof is adjustable by means of free length between the longitudinal elongated hole 204 and the bolt 206.

The height between the upper and lower stair units 207 and 207 in the straight part for the upper story is adjustable for every flight or several fights or for a particular flight by means of free length between the longitudinal elongated hole 204 and the bolt 206.

The height between the stair unit 207 for the straight part and the stair unit 217 for the top part thereof is adjustable by means of free length between the longitudinal elongated hole 204 and the bolt 206.

The straight stair provided with a landing or a curved staircase which has the curved part or is curved consecutively in its main part is built by properly fixing up the stair unit 207 for the straight part thereof, the stair unit 14 for the curved part, the stair unit 215 for the changing part and the stair unit 216 for the changing part thereof and using them together with the stair unit 217 for the top part, and the stair unit 218 for the base part thereof. To the horizontal base plate 201 of each stair unit the tread 219 is fixed.

The first formation according to the present invention has the following embodiments.

In the standard stair unit 4 as shown in FIGS. 1 to 4, the upward joint 2 and downward joint 3 thereof are formed of a quadrilaterally grooved body manufactured by bending and processing a metallic plate. The joints 2 and 3 are lightweight due to an open part in the side thereof. A lateral hole 29 which communicates with the elongated hole 5 and the nut 6 in the three sides of the upward joint 2 is bored before bending the metallic plate. The nut 6 is welded to the outer surface of the downward joint 3.

In order to insert the upward joint 2 into the downward joint 3 as tightly as possible, the inner measurements of the downward joint 3 is made as approximate as possible to the outer measurements of the upward joint 2.

The upward joint 2 is welded to the horizontal base plate 1 by inserting the lower end thereof into an angular hole 30 bored at the rear end of the horizontal base plate 1. The downward joint 3 is welded to the horizontal base plate 1 by inserting the upper end thereof into another angular hole 31 bored at the front end of horizontal base plate 1.

A reinforcing plate 32 which is bent and processed like an angular groove is welded to the side of a projecting part at the lower end of upward joint 2 and the side of the upper end of downward joint 3. The reinforcing plate 32 is welded to a lower surface of the horizontal base plate 1. Between the downward joint 3 and the horizontal base plate 1, a pair of triangular reinforcing plates 33 are welded symmetrically.

Figure 23:
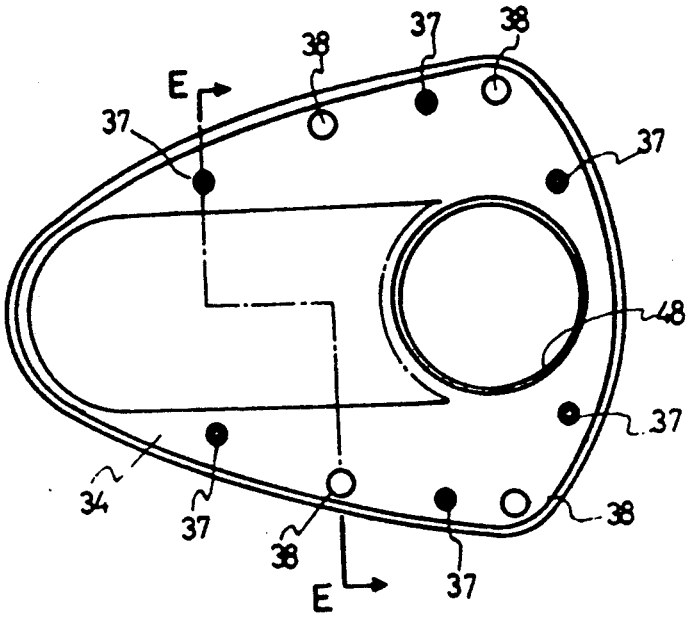
FIG. 23 is a top plan view of a covering body assembled with the assembled staircase of FIG. 20.
Figure 24:
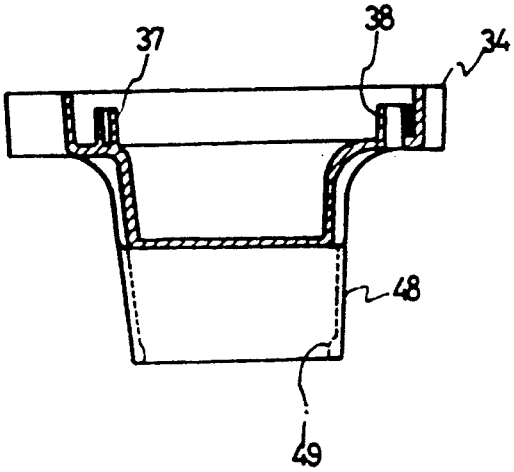
FIG. 24 is a sectional view of FIG. 23, taken along line E—E.

The horizontal base plate 1, the upward joint 2 and the downward joint 3 which are connected to each other such as a framework of the stair unit 4. However, in order to improve its external appearance when installed in a building, the framework is covered with a plastic molded dressing cover 34 as shown in FIGS. 23 and 24.

The cover 34 is fixed to the horizontal base plate 1 by spirally inserting a tapping screw 36 into a screw receiving case 37 in the inner wall of the cover 34 from a plurality of longitudinal holes 35 such as, for example, six holes bored in the outer edge of the horizontal base plate 1 before the staircase is fixed up as illustrated in FIG. 20.

The case 30 which receives a tread fixing screw 40 is installed in the bottom of the cover 34.

As illustrated in FIG. 20, the tread 8 is fixed to the upper side of the horizontal base plate 1 by spirally inserting a screw 40 into the four spiral holes 39 bored in the outer edge of the horizontal base plate 1 and, in order to install the tread 8 correctly at the horizonal position, a level adjusting plate 41 is inserted between the tread 8 and the horizontal base plate 1 (FIG. 20).

Figure 22:
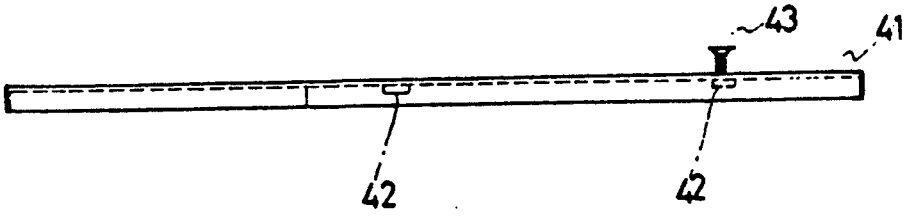
FIG. 22 is a front elevational view of the level adjusting plate of FIG. 21.

The level adjusting plate 41 has nuts 42 as welded to the under surface of the edge thereof, as shown in FIGS. 21 and 22, and the front end of a screw 43 spirally inserted into the nut meets to contact with the upper surface of the horizontal base plate 1.

The level adjusting plate 41 can be installed horizontally by increasing or decreasing the depth of spirally inserting the four screws 43 and the tread 8 which meets to contact with the upper surface thereof can also be installed horizontally.

In the rear end of the level adjusting plate 41, a circular hole 44 disposed in the upward joint 2 is bored. In the front end of the level adjusting plate 41, a hole 45 through which the tread fixing screw 40 is bored. A downward edge 46 formed in the outer circumference of the level adjusting plate 41 is secured with the upper end of the cover 34.

When the height between the upper and lower units 4 and 4 is adjusted, an opening is formed between the lower end of the cover 34 and the upper surface of the level adjusting plate 41 and the base end of upward joint 2 is exposed. In order to avoid such an unsightly appearance, a plastic cover case 47 has the same color as that of the cover 34.

Figure 25:
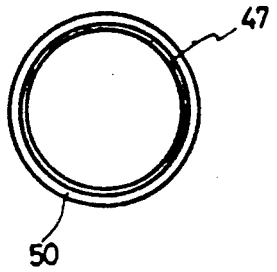
FIG. 25 is a top plan view of the disassembled covering body of FIG. 20.
Figure 26:
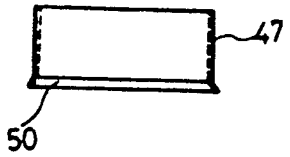
FIG. 26 is a front view of the covering body of FIG. 25.

The cover case 47 has a cylindrical configuration (FIGS. 25 and 26). The cover case 47 is inserted into the lower cylindrical part 48 of the cover 34 when the upward and downward joints 2 and 3 of upper and lower stair units are inserted and fixed.

In the inner surface of the lower cylindrical part 48, a circular concave part 49 is formed. The cover case 47 is kept still by bringing the upper inserting end thereof into an elastic contact manner with the circular concave part 49. In order to positively check the rotation of cover case 47, an upper jaw 50 at the lower end of cover case 47 must be fixed to the level adjusting plate 41.

The basic formation of other standard stair unit 4 and angle adjusting stair units 4A to **4*f* is the same as the standard stair unit excepting for structure in which the separately formed upward joint 2 or downward joint 3 is connected to the horizontal base plate 1**.

Figure 5:
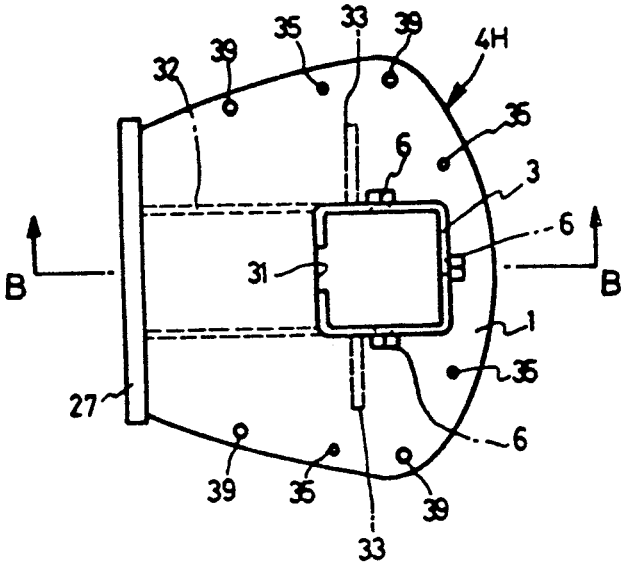
FIG. 5 is a top plan view of a second embodiment of the stair unit of the assemblable-disassemblable staircase according to the present invention.
Figure 6:
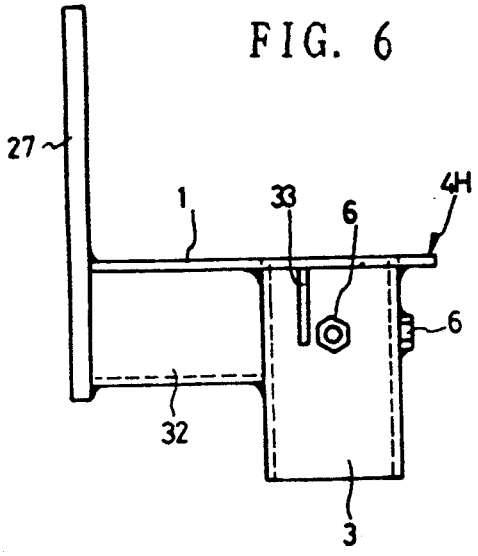
FIG. 6 is a front elevational view of FIG. 5.
Figure 7:
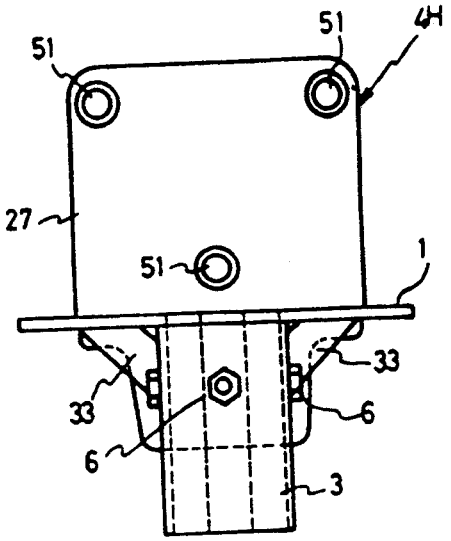
FIG. 7 is a right side elevational view of FIG. 5.
Figure 8:
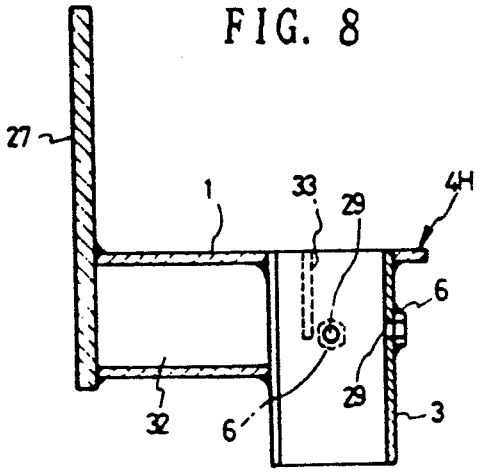
FIG. 8 is a sectional view of FIG. 5, taken along line B—B.

The stair unit 4H for the base part as illustrated in FIGS. 5 and 8 is formed like the standard stair unit with its base end being cut off.

In the bracket plate 27 vertically welded to the horizontal base plate 1, a screw receiving hole 51 is bored in three places. Between the lower end of the bracket plate 27 and the downward joint 3, the reinforcing plate 32 is welded.

Figure 9:
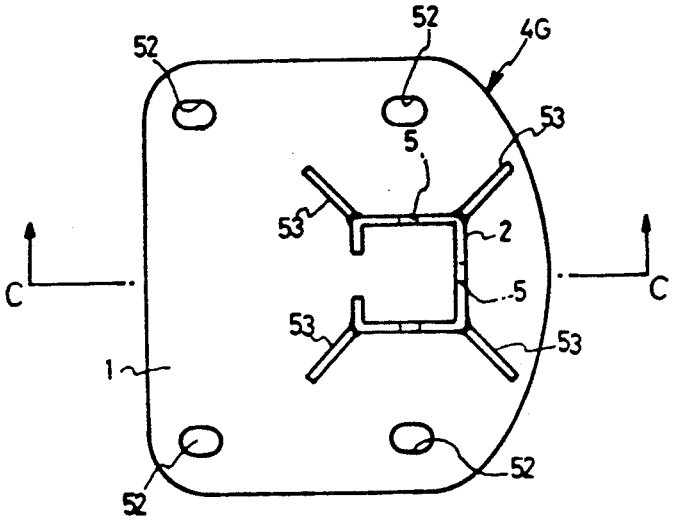
FIG. 9 is a top plan view of a third embodiment of the stair unit of the assemblable-disassemblable staircase according to the present invention.
Figure 10:
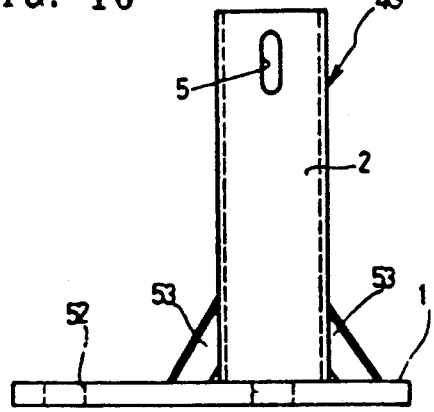
FIG. 10 is a front elevational view of FIG. 9.
Figure 11:
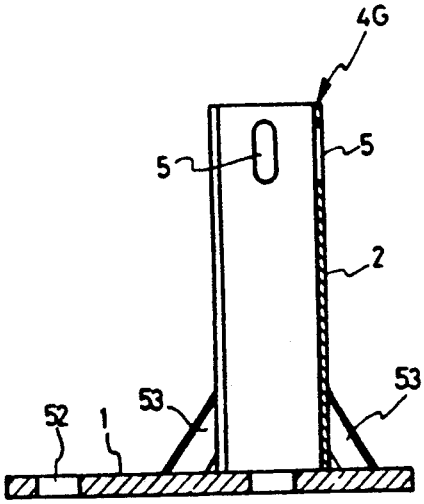
FIG. 11 is a sectional view of FIG. 9, taken along line c—c.
Figure 12:
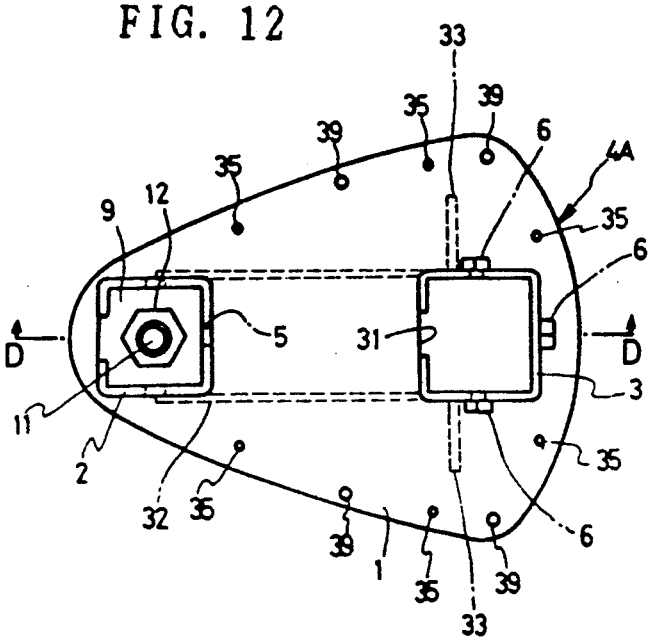
FIG. 12 is a top plan view of a fourth embodiment of the stair unit having an angle adjusting member unit of the assemblable-disassemblable staircase according to the present invention.

In the stair unit 4G for the base part thereof, as illustrated in FIGS. 9 to 11, screw receiving holes 52 are bored in the horizontal base plate 1 thereof and the holes 52 are formed like the elongated holes to make it possible to adjust installing positions.

In the lower ends of the angularly grooved upward joint 2, four reinforcing plates 53 are welded to its ridge line.

In the angle adjusting stair unit 4A as illustrated in FIGS. 12 to 15, the angularly grooved upward joint 2 is formed separately and the flat fixing plate 9 is welded to the lower end of the upward joint 2 by drawing back a little and one side-toothed or both sides-toothed washer 22 is inserted into the drawn back place.

The transparent hole 10 is bored in the center of the fixing plate 9. The fixing bolt 11 with the head thereof welded to the under surface of the horizontal base plate 1 projects its spiral axis vertically to the upper surface of the horizontal base plate 1 from the penetrating hole 54. The washer 22 is also interposed between the nut 12 and the fixing plate 9.

Figure 27:
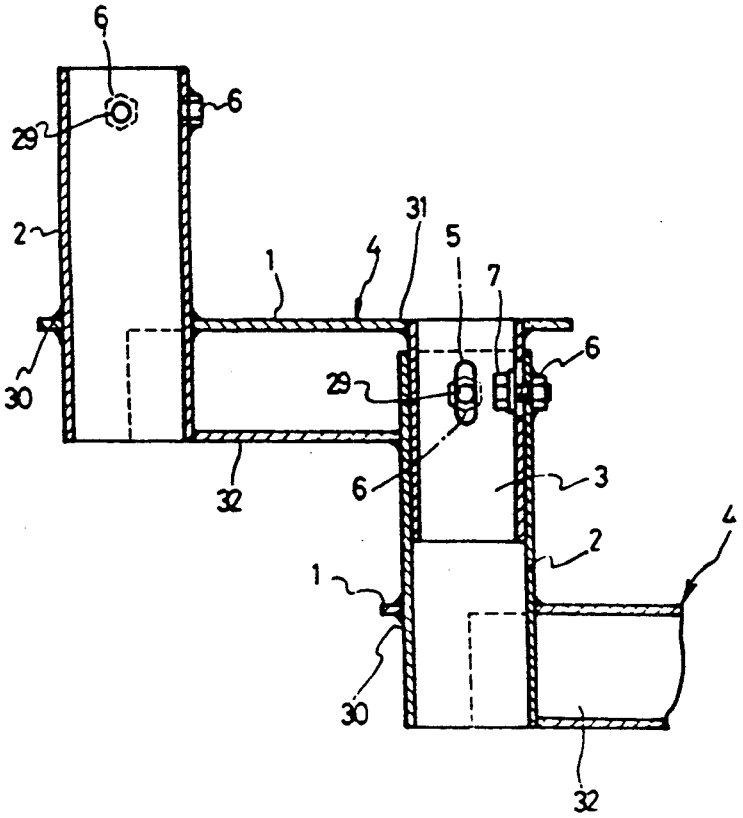
FIG. 27 is a sectional view of a fifth embodiment of the standard stair unit of assemblable-disassemblable staircase according to the present invention.

In the standard stair unit as shown in FIG. 27, the downward joint 3 is inserted into the upward joint 2 and the nut 6 is fixed to the outer surface of the upward joint 2 and the elongated hole 5 is bored in the downward joint 3.

Figure 28:
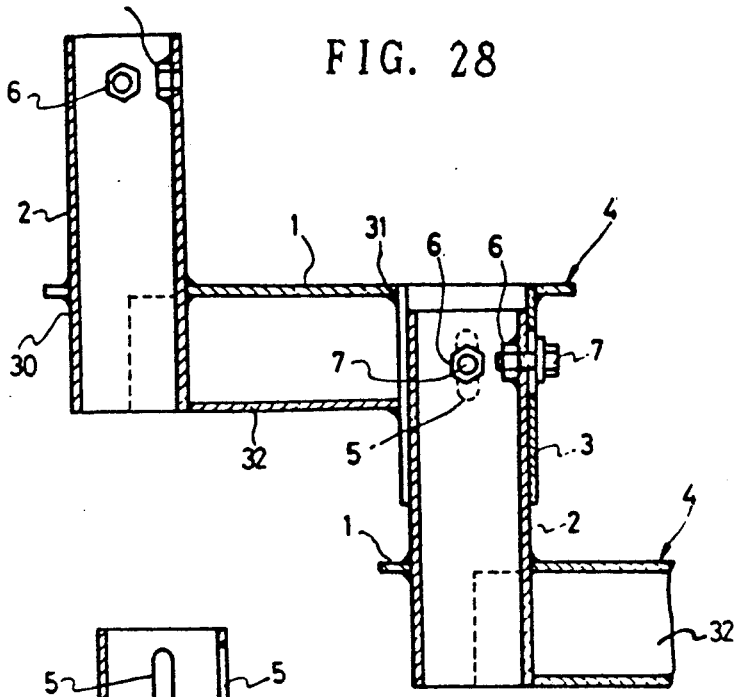
FIG. 28 is a sectional view of another embodiment of the standard stair unit according to the present invention.

In the standard stair unit as shown in FIG. 28, the upward joint 2 is inserted into the downward joint 3 and the nut 6 is fixed to the inner surface of upward joint 2 and the elongated hole 5 is bored in the downward joint 3.

Figure 29:
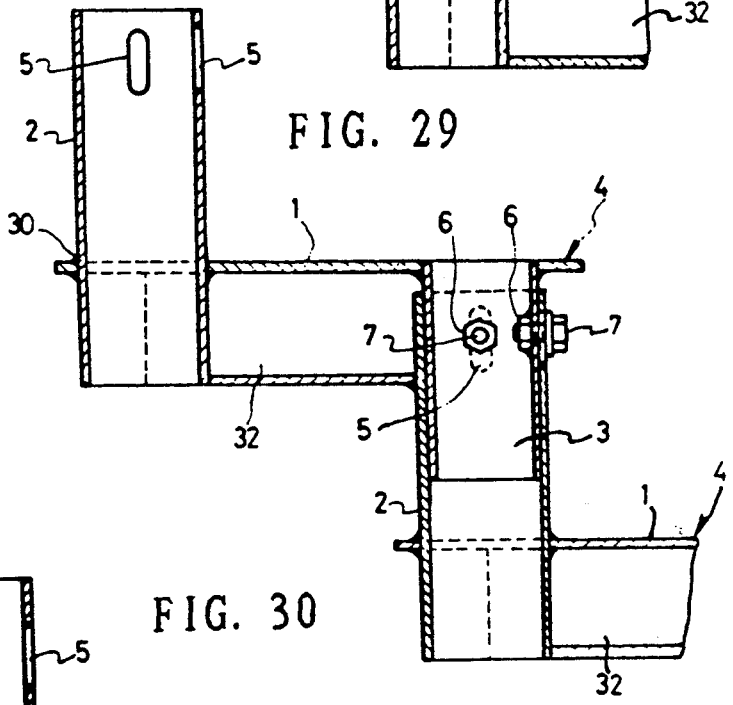
FIG. 29 is a sectional view of a further embodiment of the standard stair unit according to the present invention.

In the standard stair unit as shown in FIG. 29, the downward joint 3 is inserted into the upward joint 2 and the nut 6 is fixed to the inner surface of the downward joint 3 and the elongated hole 5 is bored in the upward joint 2. In the stair unit 4 as illustrated in FIGS. 28 and 29, the bolt 7 is tightened from the outside.

To put the cover to the stair unit 4 in the first place, the open part for inserting a driving tool must be formed in the cover. If necessary thereafter, the open part is closed with a covering member. Also, the cover can be formed separately and the separated members of the cover put to the framework can be connected and fixed by a screw stopper or an adhesive agent after the height between the upper and lower stair units is adjusted.

In the angle adjusting stair unit 4B as illustrated in FIG. 30, the quadrilateral downward joint 3 is formed separately. The bolt 11 with the head thereof welded to the horizontal base plate 1 projects perpendicularly from the under surface of the horizontal base plate 1. The flat fixing plate 9 is welded to the upper end of downward joint 3 by drawing back a little. The one side-toothed or both sides-toothed washer 22 and the head of fixing bolt 11 ar accommodated in the drawn back place. The transparent hole 10 is bored in the center of the fixing plate 9 and the washer 22 is also interposed between the nut 12 and the fixing plate 9.

In the angle adjusting stair unit 4 as illustrated in FIG. 31, the angularly grooved upward joint 2 is formed separately and the flat fixing plate 13 is welded to the lower end of the upward joint 2 by drawing back a little and the one side-toothed or both sides-toothed washer 23 is inserted into the drawn back space. The transparent hole 14 is bored in the center of the fixing plate 13. The nut 16 welded to the under surface of the horizontal base plate 1 communicates with the penetrating hole 55 bored in the horizontal base plate 1. The washer 23 is also interposed between the bolt 14 and the fixing plate 13.

In the angle adjusting stair unit 4D as illustrated in FIG. 32, the quadrilateral downward joint 3 is formed separately and the flat fixing plate 13 is welded to the upper end of downward joint 3 by drawing back a little. The nut 16 is welded to the under surface of the horizontal base plate 1 and one side-toothed or both sides-toothed washer 23 is inserted into the drawn back space. The transparent hole 14 is bored in the center of the fixing plate 13. The washer 23 is also interposed between the bolt 15 and the fixing plate 13.

In the angle adjusting stair unit 4E as shown in FIGS. 33 and 34, the flat installing plate 17 is welded to the lower end of the upward joint 2 and four penetrating holes 18 are bored in the outer circumferential edge projected from the outer side of the upward joint 2.

In the angle adjusting stair unit 4F as shown in FIG. 35, the flat installing plate 17 is welded to the upper end of the downward joint 3 and four penetrating holes 18 are bored in the outer circumferential edge projected from the outer side of the upward joint 2.

The present invention may be embodied in various forms. The upward joint 2 and the downward joint 3 may be formed of a regular polygonal or an irregular polygonal grooved body or a tubular body. The method for fixing the upward joint 2 or the downward joint 3 to the horizontal base plate 1 is not limited to welding and other known fixing methods can be employed.

In the standard stair unit 4 in which the upward joint 2 and the downward joint 3 are not rotatable for the horizontal base plate 1, the upward joint 2 or the downward joint 3 can be integrated with the horizontal base plate 1. Even in the angle adjusting stair unit, the upward joint 2 or the downward joint 3 which is not formed separately can be manufactured by fixing with the horizontal base plate 1.

The second formation according to the present invention has the following embodiments.

In the stair unit 115 for changing from the straight part to the curved part as shown in FIGS. 42 to 45, the downward joint 109 is formed of a metallic cylindrical body and the upward joint 102 formed of a quadrilateral case processed by bending a metallic plate which has a longitudinal opening disposed on one side thereof. The elongated hole 104 of the upward joint 102 is bored in the side 103 and the ring shaped horizontal seating plate 11 is welded to the central inner side of the downward joint 109.

In the stair unit 114 for the curved part thereof as shown in FIGS. 11 to 14, the upward joint 108 and the downward joint 109 are formed of a metallic cylindrical body. The fixing bolt 110 is welded to the upper covering plate 126 of the upward joint 108 and the ring shaped horizontal seating plate 111 is welded to the central inner surface of the downward joint 109.

In the stair unit 116 for changing from the curved part to the straight part as shown in FIGS. 50 to 53, the upward joint 108 is formed of a metallic cylindrical body and the fixing bolt 110 is welded to the upper covering plate 126 of the upward joint 108. The downward joint 103 is formed of a quadrilateral case processed by bending a metallic plate and the nut 105 is welded to the outer surface of three sides. The bolt 106 is spirally fixed with the nut 105 from the transparent hole 127.

In the stair unit 107 for the straight part thereof as shown in FIGS. 54 to 57, the upward joint 102 and the downward joint 103 are formed of a quadrilateral case processed by bending a metallic plate and the elongated hole 104 of the upward joint 102 is bored in three sides. The nut 105 of the downward joint 103 is welded to the outer surface of sides thereof and the bolt 106 is spirally fixed with the nut 105 from the transparent hole 127.

In any stair unit, the upward joints 102 and 108 and the downward joints 103 and 109 form a framework of the stair unit by welding to the horizontal base plate 101 together with the proper reinforcing plates.

In order to improve its external appearance when installed in a building, a plastic-molded dressing cover 125 is put thereto.

The cover 125 is fixed to the horizontal base plate 101 by the tapping screw which is spirally inserted into the transparent hole 130 bored in the outer circumferential edge of the horizontal base plate 101 before the staircase is fixed up.

When one side-toothed washer or both side-toothed washer 128 is inserted between the head of bolt 106 and the upward joint 102, between the upper nut 112 and the horizontal seating plate 111, and between the lower nut 113 and the horizontal seating plate 111 and fastened to each contacting surface thereof by tightening the bolt 106 or the upper nut 112 so that it can be fixed thereto very strongly and firmly.

The tread 119 is fixed to the upper surface of the horizontal base plate 101 by spirally inserting the screw vis into the spiral hole 129 bored in the outer edge of horizontal base plate 101. In order to install the tread 119 correctly at a horizontal position, the level adjusting plate can be inserted between the tread 119 and the horizontal base plate 101. The level adjusting plate is installed by spirally inserting four vises into the nuts welded to the under surface of outer circumferential edge. It can be installed horizontally increasing or decreasing the depth of spirally inserting the screws and the tread 119 which meets to contact with the upper surface of the horizontal base plate 101 can also be installed horizontally. In the upper nut 112 and in the lower nut 113, a driving tool inserting slot 131 and a longitudinal hole 132 are bored.

In another embodiment as illustrated in FIGS. 58 to 70, a horizontal plate 133 is welded to the central inner surface of the upward joint 108 and the fixing bolt 110 of the upward joint 108 is welded to the central part of the horizontal plate 133. The horizontal seating plate 11 of the downward joint 109 is formed of the bottom plate with a pot shaped cylindrical body 134 and a jaw 135 at the upper end of the cylindrical body 134 is fixed to the horizontal plate 101 by a screw 136. Other formations and assemblings are the same as the beforesaid embodiments. The sectional shapes of the upward joints 102 and 108 and the downward joints 103 and 109 are not specifically limited to those illustrations.

The third formation according to the present invention has the following embodiments.

In the stair unit 215 for changing from the straight part to the curved part as shown in FIGS. 77 to 80, the downward joint 209 is formed of a metallic cylindrical body. The upward joint 202 formed of a quadrilateral case processed by bending a metallic plate having a longitudinal elongated hole disposed in one side thereof. The elongated hole 204 of the upward joint 202 is bored in the three sides and the ring shaped horizontal seating plate 211 is welded to the central inner surface of the downward joint 209. In the horizontal seating plate 211, four openings 232 are provided for inserting the two folding shaped driving tool of the movable case 210 around the longitudinal hole 240 for inserting the bolt 212.

In the stair unit 214 for the curved part thereof as shown in FIGS. 81 to 84, the upward joint 208 and the downward joint 209 are formed of a metallic cylindrical body. The ring shaped horizontal seating plate 211 is welded to the central inner surface of the downward joint 209 and the bolt 212 is inserted from the longitudinal hole 240 in the center of the horizontal seating plate 211. In the horizontal seating plate 211, an opening 232 is provided for inserting the driving tool of the movable case 210. The horizontal plate 226 is welded to the upper end of the movable case 210. The stair unit 213 is welded to the under surface of horizontal plate 226 and the bolt 212 is inserted from the longitudinal hole 239 of the horizontal plate 226. In the horizontal plate 226, four transparent holes 231 for inserting the driving tool are provided around the longitudinal hole 239. To the lower end of the movable case 210, a spiral case 237 is welded. In the inner circumference at the lower end of the upward joint 208, a female screw 238 with which the spiral case 237 is spirally secured.

In the stair unit 216 for changing from the curved part to the straight part thereof as shown in FIGS. 85 to 88, the upward joint 208 is formed of a metallic cylindrical body and the downward joint 203 is formed of a quadrilateral case processed by bending a metallic plate. The nut 205 is welded to the outer surface of three sides and the bolt 206 is spirally fixed with the nut 205 from the transparent hole 227. The horizontal plate 226 is welded to the upper end of the movable case 210. Into the nut 213 welded to the under surface of horizontal plate 226, a bolt 212 is inserted from the longitudinal hole 239 of the horizontal plate 226. In the horizontal plate 226, four transparent holes 231 for inserting a driving tool is provided. At the lower end of the movable case 210, the welded spiral case 237 is spirally fixed with the female screw 238 in the inner circumferential surface at the upper end of the upward joint 208.

In the stair unit 207 for the straight part thereof as shown in FIGS. 89 to 92, the upward joint 202 and the downward joint 203 are formed of a quadrilateral case processed by bending a metallic plate. The elongated hole 204 of the upward joint 202 is bored in the three sides. The nut 205 of the downward joint 203 is welded to the outer surface of three sides and the bolt 206 is spirally fixed with the nut 205 from the transparent hole 227.

In any stair unit, the upward joints 202 and 208 and the downward joints 203 and 209 form a framework of the stair unit by welding to the horizontal base plate 201 together with the proper reinforcing plates. In order to improve its external appearance when installed in a building, a plastic molded dressing cover 225 is put thereto. The cover 225 is fixed to the horizontal base plate 201 by a tapping screw which is spirally inserted into the transparent hole 230 bored in the outer circumferential edge of the horizontal base plate before the staircase is fixed up.

When one side-toothed washer or both side-toothed washer 228 is inserted between the head of bolt 206 and the upward joint 202, between the bolt 212 and the horizontal seating plate 211, and between the horizontal plate and the horizontal seating plate 211, it is fastened to its each contacting surface by tightening the bolt 206 or the bolt 212 and it can be fixed thereto very strongly and firmly.

The tread 219 is fixed to the upper surface of the horizontal base plate 201 by spirally inserting a screw into the four spiral holes 229 bored in the outer edge of the horizontal base plate 201. In order to install the tread correctly at a horizontal position, the level adjusting plate can be inserted between the tread 219 and the horizontal base plate 201. The level adjusting plate is installed by spirally inserting four screws into the nuts welded to the under surface of outer circumferential edge. It can be installed horizontally by increasing or decreasing the depth of spirally inserting the screws and the tread 219 which meet to contact with the upper surface of the horizontal base plate 201 can also be installed horizontally.

In another embodiment as shown in FIGS. 93 to 105, the horizontal plate 226 is welded to the central inner surface of the movable case 210 and the nut 213 is welded to the under surface of the horizontal plate 226. To the upper end of the upper joint 208, a spiral case 241 is welded and the spiral case 241 is spirally fixed with a female screw in the lower inner circumference of the movable case 210. The horizontal seating pate 211 of the downward joint 209 is formed of the bottom plate having a pot shaped cylindrical body 234 and a jaw disposed at the upper end of the plate 201 by a screw 236. Other formations and operations are as the beforesaid embodiments.

Each sectional shape of the upward joints 202 and 208 and the upward joints 203 and 209 is not specifically limited to those illustrations, if they are inserted are fixed unrotatably or rotatably depending on the place where the stair unit is used. A hexagonal or octagonal or oval case can be used fittingly.

The longitudinal long hole 5 is formed in one side of the upward joint 2 and downward joint 3 and the nut 6 is installed in the other side of the upward and downward joints 2 and 3. The upward joint 2 and downward joint 3 are fixed by spirally inserting the bolt 7 into the nut 6 from the elongated hole 5.

As the upper and lower stair units 4 and 4 can be connected with only the upward joint 2, the downward joint 3, the bolt 7, and the nut 6. The number of constituent parts is small and manufacturing cost is thereby reduced. At the same time, it is labor saving because the stair unit is light.

In addition, it is not necessary to weld such connecting members to the upward joint 2 or the downward joint 3. Thus, the constituent parts can be fixed easily and efficiently.

As the transverse sections of the upward joint 2 and the downward joint 3 are not circular, the upper and lower stair units 2 and 3 are not rotatable under the condition that the upward joint 2 and the downward joint 3 are inserted and fixed. Therefore, the staircase can be easily and correctly fixed up.

In the stair units 4A, one side of the upward joint 2 and one side of the downward joint 3 are formed by separating from the horizontal base plate 1, and a fixing plate 9 is fixed to the separate upward joint 2 or the separate downward joint 3. The transparent hole 10 is bored on the longitudinal central line of the separate upward joint 2 or downward joint 3 in the fixing plate 9 and the bolt 11 is inserted through the transparent hole 10 vertically installed in the horizontal base plate 1. The separate upward joint 2 or downward joint 3 is fixed to the horizontal base plate 1 by spirally fixing the nut 12 with the bolt 11 after giving a required turn to the separate upward joint 2 or downward joint 3 for the horizontal base plate 1. The upward joint 2 and the downward joint 3 is fixed by spirally inserting the bolt 7 into the nut 6 fixedly installed on the side of the upward joint 2 and the downward joint 3 form the longitudinal elongated hole 5 bored on the one side of the upward joint 2 and the downward joint 3. Therefore, the arrangement angle and height between the upper and lower stair units are adjustable. Thus, such stair units can be widely used in various buildings. Also, a spiral staircase or a staircase with a landing can be fixed up optionally.

In the stair units 4B according to the present invention, one side of the upward joint 2 and one side of the downward joint 3 are formed by separating from the horizontal base plate and the fixing plate 13 is fixed to the separate upward joint 2 or downward joint 3. The bolt 15 is inserted through the transparent hole 14 of the fixing plate 13 bored on the longitudinal central line of the separate upward joint 2 or downward joint 3. The separate upward joint 2 or downward joint 3 is fixed to the horizontal base plate 1 by spirally inserting the bolt 15 into the nut 16 fixedly installed in the horizontal base plate 1 after giving a required turn to the separate upward joint 2 or downward joint 3 for the horizontal base plate 1 with the bolt 15 as the center. Also, the upward joint 2 and the downward joint 3 are fixed by inserting the bolt 7 into the nut 6 fixedly installed on the other side of the upward joint 2 and downward joint 3 from the longitudinal elongated hole 5 bored on the one side of upward joint 2 and downward joint 3. Therefore, the arrangement angle and height between the upper and lower stair units are adjustable. Thus, such stair units can be widely used in various buildings. Also, a spiral staircase or a staircase with a landing can be fixed up optionally.

In the stair unit 4C according to the present invention, one side of the upward joint 2 and one side of the downward joint 3 are formed by separating from the horizontal base plate 1, and the installing plate 17 is fixed to the separate upward joint 2 or downward joint 3. The separate upward joint 2 or the downward joint 3 is fixed to the horizontal base plate 1 by spirally inserting the tapping screw 19 into the receiving hole 20 bored in the horizonal base plate 1 from the penetrating hole 18 bored in the installing plate 17 after giving a required turn to the separate upward joint 2 or downward joint 3 for the horizontal base plate 1. Also, the upward joint 2 and the downward joint 3 are fixed by spirally inserting the bolt 7 into the nut 6 fixedly installed on the other side of upward joint 2 and downward joint 3 from the longitudinal elongated hole 5 bored on the one side of upward joint 2 and downward joint 3. Therefore the arrangement angle and height between the upper and lower stair units are adjustable. Thus, such stair units can be widely used in various buildings. Also, a staircase with a landing or a spiral staircase can be fixed up optionally.

In order to adjust the arrangement angle between the upper and lower stair units according to the present invention, all stair units 4A, 4B, and 4C are not rotatable. Only the upward joint 2 or the downward joint 3 which is formed by separating from the horizontal base plate 1 is made rotatable. It enough for that the relatively light upward joint 2 or downward joint 3 is kept still at its arrangement angle. As the stair units can be fixed up efficiently without an assistant worker, labor cost can be reduced to a considerable degree.

The upward joint and the downward joint 3 are formed of a quadrilateral case or a quadrilateral grooved body manufactured by bending and processing a metallic plate and boring or cutting in the upward joint 2 or in the downward joint 3 can be performed efficiently without a special tool.

Furthermore, the upward joint 2 and the downward joint 3 are fixed by interposing one side-toothed washer or both side-toothed washer 21 between the head of the bolt 7 and the upward joint 2 or the downward joint 3. Therefore, the upward joint 2 and the downward joint 3 are connected firmly by sticking of the washer 21 to its contacting surface and the upper and lower stair units are not loosened along the longitudinal elongated hole. Thus, the height between each stair units is not changeable from its original measurements and the stair units can be used in a stabilized condition.

Also, the upward joint 2 or the downward joint 3 is fixed to the horizontal base plate 1 by interposing one side-toothed washer or both side-toothed washer 23 between the fixing plate 13 and the horizontal base plate 1 or between the bolt 15 and the fixing plate 13 so that the upward joint 2 or the downward joint 3 can be connected firmly with the horizontal base plate 1 by sticking of the washer 23 to its contacting surface. As the upward joint 2 or the downward joint 3 is not rotatable with the bolt 15 as the center, the arrangement angle between each stair unit is not changeable and the stair units can be used in a stabilized condition.

In the second formation of the staircase according to the present invention as described hereinabove, the height between the stair units 107 and 107 for the straight part, the height between the stair unit 107 for the straight part and the stair unit 115 for the changing part, the height between the stair unit 115 for the changing part and the stair unit 114 for the curved part, the height between the stair units 114 and 114, the height between the stair unit 114 for the curved part and the stair unit 116 for the changing part and the height between the stair unit 116 for the changing part and the stair unit 107 for the straight part are adjustable. At the same time, the arrangement angle between the stair unit 115 for the changing part and the stair unit 114 for the curved part, the arrangement angle between the stair units 114 and 114 for the curved part, and the arrangement angle between the stair unit 114 for the curved part and the stair unit 116 for the changing part are adjustable consecutively so that the portable, assemblable-disassemblable staircase can be widely used in various buildings, and a spiral staircase or a staircase provided with a landing can be fixed up optionally.

And, as the rotation or movement of the stair unit 114 for the curved part is kept in check by being bound by the stair unit 117 for top part fixed to the floor 124 of upper story and the stair unit 118 for the base part fixed to the floor 120 of lower story, and the stair unit 107 for straight part and the stair unit 115 for the changing part which are unrotatably united with the stair units 117 and 118, the portable, assemblable-disassemblable staircase does not cause a shake not only in whole but also in the landing or in the curved part.

In the staircase according to the present invention, the arrangement angle between the stair unit 215 for the changing part and the stair unit 214 for the curved part, the arrangement angle between the stair units 214 and 214 for the curved part, and the arrangement angle between the stair unit 214 for the curved part and the stair unit 216 for the changing part is adjustable consecutively. At the same time, the height between the stair units 207 and 207 for the straight part, the height between the stair unit 207 for the straight part and the stair unit 215 for the changing part, the height between the stair unit 215 for the changing part and the stair unit 214 for curved part, the height between the stair units 214 and 214, the height between the stair unit 214 for the curved part and the stair unit 216 for changing part and the height between the stair unit 216 for the changing part, and the stair unit 207 for the straight part is adjustable. Consequently, it can be widely used in various buildings, and spiral staircase or a staircase provided with a landing can be fixed up optionally.

And, as the rotation or movement of the stair unit 214 for the curved part is held in check by being bound by the stair unit 217 for the top part fixed to the floor 224 of the upper story and the stair unit 218 for the base part fixed to the floor 220 of the lower story, and the stair unit 207 for the straight part and the stair units 215 and 216 for the changing part which are unrotatably fixed with the stair units 217 and 218, the portable, assemblable-disassemblable staircase does not cause a shake not only in whole but also in the landing or in the curved part.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A portable, assemblable-disassemblable staircase including a plurality of stair units to be assembled and disassembled, each of said stair units comprising:

a horizontal base plate, an upward joint vertically installed at a rear end of said horizontal base plate, said upward joint containing three longitudinal elongated holes bored in a front, left, and right side walls thereof, a downward joint vertically installed at a front end of said horizontal base plate, said downward and said upward joints being formed of a quadrilateral case manufactured by bending and processing a metallic plate, three nuts fixedly installed in said downward joint, three bolts adapted to be spirally inserted into said three nuts through said three longitudinal elongated holes of said upward joint so as to inserting and fixing said downward joint of one stair unit into and to said upward joint of the other stair unit of said plurality of stair units so that the height of said plurality of stair units can be easily adjusted by the longitudinal elongated holes and the mutual stair units can be tightly secured to each other by three way securing members through three bolts and nuts, and a tread to be fixed to the upper surface of said horizontal plate, whereby the plurality of stair units are assembled by alternatively mating with said downward joint and said upward joint so that horizontal sections of the downward and upward joints can be perfectly prevented from circularizing to be unrotatable.

2. The portable, assemblable-disassemblable staircase of claim 1, wherein the downward and upward joints are formed of a quadrilateral grooved body manufactured by bending and processing a metallic plate.

* * * * *